US006647231B2

(12) United States Patent
Funabashi

(10) Patent No.: US 6,647,231 B2
(45) Date of Patent: Nov. 11, 2003

(54) ELECTRICALLY CONDUCTIVE MEMBER AND IMAGE FORMING APPARATUS EQUIPPED WITH THE SAME

(75) Inventor: Eiji Funabashi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/097,474

(22) Filed: Mar. 15, 2002

(65) Prior Publication Data

US 2003/0044199 A1 Mar. 6, 2003

(30) Foreign Application Priority Data

Aug. 21, 2001 (JP) ..... 2001-250690
Jan. 29, 2002 (JP) ..... 2002-020209

(51) Int. Cl.[7] ..... G03G 15/02

(52) U.S. Cl. ..... 399/176; 361/221; 361/225; 399/168; 399/313

(58) Field of Search ..... 399/176, 174, 399/168, 313; 361/221, 225

(56) References Cited

U.S. PATENT DOCUMENTS 4,922,299 A * 5/1990 Uchimoto et al. ..... 399/168
6,023,597 A * 2/2000 Mayuzumi et al. ..... 399/176

* cited by examiner

*Primary Examiner*—Sophia S. Chen
(74) *Attorney, Agent, or Firm*—Oliff & Berridge, PLC

(57) ABSTRACT

The present invention discloses: (1) an electrically conductive member including: a cylindrical base body; and electrically conductive powder sealed inside of the cylindrical base body in a substantially flowable state, or (2) an electrically conductive member including: a cylindrical base body; and electrically conductive powder sealed inside of the cylindrical base body so as not to completely fill the inner volume thereof, or (3) an electrically conductive member including: a cylindrical base body; and electrically conductive powder sealed inside of the cylindrical base body so as to fill only from 20 to 95% of the inner volume thereof. Moreover, the present invention discloses an image forming apparatus equipped with any of the electrically conductive members.

38 Claims, 8 Drawing Sheets

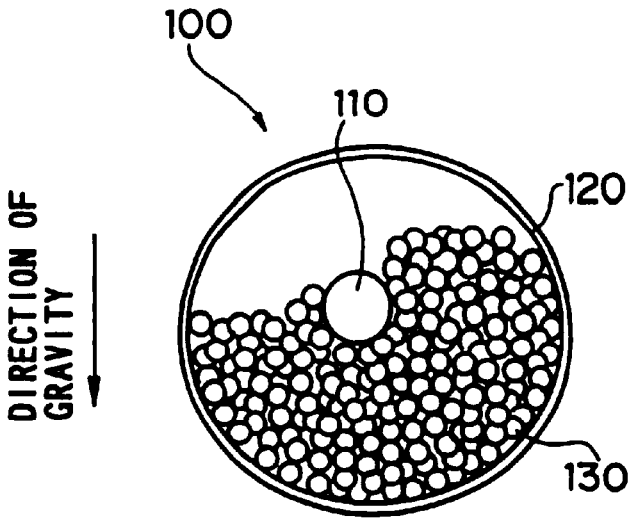
FIG. 4
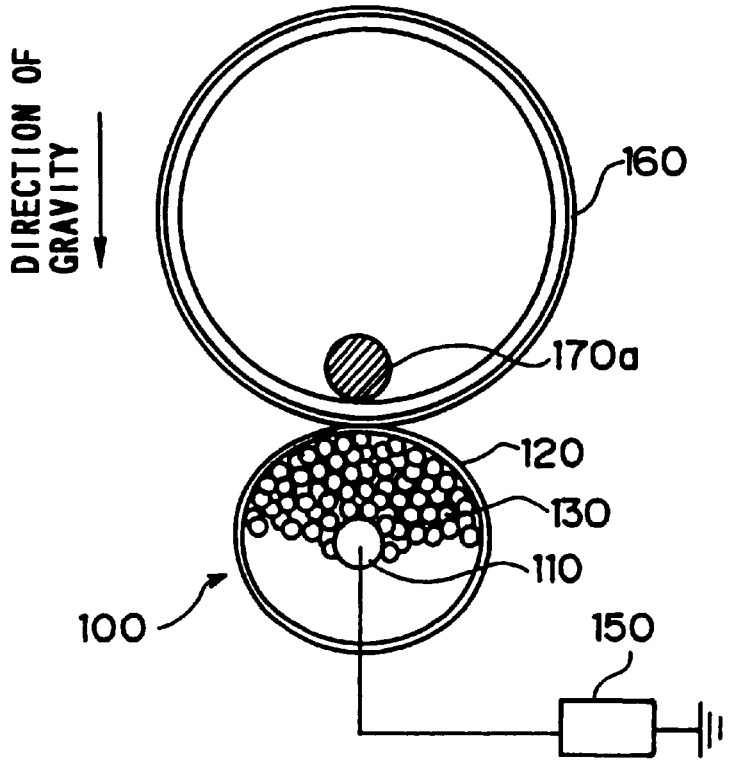

ELECTRICALLY CONDUCTIVE MEMBER AND IMAGE FORMING APPARATUS EQUIPPED WITH THE SAME

BACKGROUND OF THE INVENTION

1. Field of the Invention

The present invention relates to an electrically conductive member capable of being used in an electrophotographic apparatus running on an electrophotographic process, such as a copy machine, a printer, a facsimile device and the like, and an image forming apparatus equipped with the electrically conductive member.

2. Description of the Related Art

As electrophotographic processes, many have been known as described in Japanese Patent Application Publication (JP-B) No. 42-23910. In general, an electrographic process includes plural steps of: electrically forming, by various means, a latent image on the surface of a photosensitive member (latent image bearing member) made from a photoconductive material; forming a toner image by developing the formed latent image with a toner; thereafter transferring the toner image on the surface of the photosensitive member, by way of an intermediate transfer member or directly, onto the surface of a transfer substrate such as paper or the like; and fixing the transferred image by heating, applying pressure, conducting hot-press, or using a solvent vapor or the like, to obtain a fixed image. The toner remaining on the surface of the photosensitive member, when required, is cleaned by means of various methods to be recycled in the above plural steps.

In an image forming apparatus for forming an image using the electrophotographic process, there have been typically adopted a contact charge type or a contact transfer type with very small generation of ozone. In such types, preferably used is a member in the shape of a roller excellent in wear-resistance and in transportability of a transfer substrate in a transfer section.

As the member in the shape of a roller, used generally is a semiconductive roller with a structure that a semiconductive elastic layer having a resistance value in the range of $1\times10^5$ to $1\times10^{12}\Omega$ adjusted by addition of carbon, an ion conductive agent or the like is formed on a core metal made of stainless steel (SUS), iron or the like. Such a semiconductive roller has an elastic layer and the elastic layer is pressed to the photosensitive member or the intermediate transfer member, which is an image bearing member, to enable a nip to be formed with certainty.

In the semiconductive roller, various components are included in rubber of the elastic layer: such as residuals of a reaction initiator added in synthesis for a base polymer, a by-product accompanying the synthesis, a low molecular component of the base polymer, and a vulcanizer, softner and plasticizer added in molding of a rubber roller. If the semiconductive roller is left for a long time in press contact with a photosensitive member or an intermediate transfer member, a phenomenon occurs with ease that the components in the roller seep out on the surface of the elastic layer, which is a so-called bleeding. Most of the seeping-out components are easy to react with the photosensitive member or the intermediate transfer member, leading a problem that the components attach onto the surfaces of the photosensitive member or the intermediate transfer member to denature physical properties of the surfaces thereof via chemical reactions.

Furthermore, an elastic layer of a semiconductor roller is adjusted on its surface resistance by mechanically mixing and dispersing carbon, a metal oxide or an ion conductive agent into a rubber material and in a case where an ion conductive agent is adopted, the elastic layer not only receives a change in physical properties thereof in an environment at high temperature and high humidity, but also precipitates the ion conductive agent out on the surface thereof, thereby having resulted in a problem of a local change in surface electrical resistance value thereof. Moreover, if the semiconductive roller is left in press contact with a photosensitive member or an intermediate transfer member, there has been a case where a problem arises that the precipitated ion conductive agent contaminates the photosensitive member and the intermediate member.

In order to solve the problems, an idea comes to mind that coating is applied on the surface of an elastic layer of a semiconductive roller with a material serving as a barrier layer for preventing a component contained in the elastic layer from seeping out or precipitating on the surface thereof, whereas by the coating, the semiconductive roller is of a plural layer structure, which again produces a problem of a high cost due to increases in material cost and complexity of fabrication process.

Recently, on the other hand, in an image forming apparatus running on an electrophotographic process has come to be desired for quietness. A charging roller, one kind of semiconductive roller, produces a so-called charging sound therefrom, which is an unpleasant, offensive sound, when a high frequency AC bias is superimposed on a DC bias and reduction in such a charging sound has remained a great technical problem.

As one of methods to reduce the charging sound, a method has been proposed in which a weight is put into the interior of a photosensitive member in contact with the charging roller to prevent high frequency vibrations caused by the charging roller from propagating. However, in this method, a necessity arises for a new process that a member serving as a weight is fixed in place inside of the photosensitive member, for example a adhesion process, inevitably leading to cost-up. Moreover, as an alternative for reduction in charging sound, a method has been adopted in which a foamed layer is provided on a charging roller to absorb the vibrations. However, in this method, the material of the foamed layer is rubber and thus inevitably disables a photosensitive member in contact therewith. That is, an adverse influence therefrom as described above cannot be avoided.

Moreover, in an image forming apparatus running on an electrographic process, a long life of a photosensitive member has been desired for reduction in unit price of prints and photocopies (in other words, referred to as reduction in running cost). The surface of a charging roller in contact with a photosensitive member is, however, scraped with ease by discharge produced in a tiny gap between the photosensitive member and the charging roller, or in other words by a so-called etching phenomenon, in a case where a high frequency AC bias is superimposed on a DC bias; thereby, having lead to a problem of no realization of a long life photosensitive member.

A proposal has been made on a method that only DC bias is applied to a charging roller, in other words a so-called DC charging, as a method of reducing the charging sound and the etching phenomenon. In order to charge the charging roller in a uniform manner with such a DC charging, requirements arise for more of resistivity uniformity and a higher level surface smoothness of the charging roller as compared with requirements thus far. However, a charging roller has components contained in an elastic layer that bleeds with ease as described above and in addition, toner, paper powder and the like are attached onto the surface thereof with ease due to a conductivity thereof; therefore, the charging roller has had a problem of virtually no possibility of retaining resistance uniformity and surface smoothness with no achievement of fundamental solution of the problem.

A proposal has been made on another method for reduction in charging sound and etching phenomenon of a photosensitive member that is a new charging technique for the surface of an image bearing member, which is called injection charging, and adopted in part of apparatuses on the market. Since such a technique enables an applied DC bias to be a potential on the surface of a photosensitive member as is, no requirement arises for application of an AC bias theoretically.

The injection charging technique is, however, a technique requiring a combination of a member of a structure in which magnetic powder is held on the outer peripheral surface of a metal sleeve by the action of a magnet inside of the metal sleeve, in other words a magnetic bush charging member, and a photosensitive member with a charge injection layer, and the combination of a magnetic brush and a photosensitive member with a charge injection layer has had a weak point that any of the components is expensive.

Moreover, in the injection charge technique, a necessity arises for a higher speed rotation of a magnetic brush than that of a photosensitive member with a charge injection layer to increase in chance of charge injection. For this reason, another necessity arises for a power transmission mechanism for driving gears and a belt residing between the magnetic brush and the photosensitive member. Moreover, since a surface of a photosensitive member continues to be rubbed by metal powder as a magnetic material, naturally the surface of a photosensitive member is mechanically scraped by an abrasive action and even an imperceptible possibility exists that as deep a wound as to pass through the charge injection layer is produced in some instance.

Moreover, contaminants such as toner, paper powder and so on attach onto magnetic powder present on an outer peripheral surface of a metal sleeve to change an electrical resistance value, in company with which problematic cases occur where a charge injection ability decreases, where magnetic powder on the outer peripheral surface of a metal sleeve falls off to reduce a charge injection density and where the falling off magnetic material arrives at an image (on a paper sheet) to cause an image defect.

On the other hand, in a case where the semiconductive roller is used as transfer means or a second transfer means in an intermediate transfer method, it is requested that not only is the semiconductive roller adapted to various kinds of transfer substrates such as a thin paper sheet, a thick paper sheet, further an OHP sheet and the like, but a nip is also formed with certainty in any of a photosensitive roller and an intermediate transfer member, thereby preventing occurrence of an image defect and paper wrinkles caused by poor transportation of a transfer substrate. The requests are responded by restricting a hardness of a semiconductive roller to the lowest possible level and further, pressing down the roller deeply into a photosensitive member or an intermediate transfer member, but a problem has remained that additive amounts of a softner, a plasticizer and the like described above are forced to increase on the elastic layer; therefore bleeding occurs with more of ease to contaminate the photosensitive member or the intermediate transfer member and to produce a state easy to denature the members.

Moreover, there have been faults in semiconductive roller combined with a transfer substrate, such faults including: properties of a transfer substrate differ according to a humidity and a temperature, by which an electrical resistance value is greatly varied; and, in cases where the semiconductive roller uses a rubber material in order to obtain a low hardness as described above, properties of the semiconductive roller differ also according to a humidity and a temperature by which an electrical resistance value is greatly varied. Therefore, in a case of combination of a transfer substrate with the semiconductive roller which tend to have a great change in physical properties, a necessity arise for selecting transfer conditions according to an appropriate resistance value in each of the transfer substrate and the semiconductive roller in order to keep a constant image quality in various environments; with the result that in a prior art electrophotographic image forming apparatus, a temperature sensor and a humidity sensor were equipped therewith and a complexity control was required for feeding back detected environmental data and resistance data to determine a transfer bias.

SUMMARY OF THE INVENTION

Accordingly, the present invention has tasks to solve the problems in the prior art and to achieve the following objects. That is, it is an object of the present invention to provide an electrically conductive member capable of not only forming a desired nip with certainty, simplicity and ease at a low cost but also preventing contamination or denaturation of a photosensitive member or an intermediate member and an image forming apparatus with the electrically conductive member. Moreover, it is another object of the present invention to provide an electrically conductive member capable of reducing a charging sound and an etching phenomenon on an image bearing member and an image forming apparatus with the electrically conductive member. Furthermore, it is still another object of the present invention to provide an electrically conductive member excellent in resistance uniformity and surface smoothness and an image forming apparatus with the electrically conductive member.

The present inventor found a structure of an electrically conductive member capable of fundamentally solving the problems owned by the electrically conductive member and has reached the present invention.

The above objects can be achieved the following features of the present invention:

According to a first aspect of the present invention, there is provided an electrically conductive member, including: a cylindrical base body; and electrically conductive powder sealed inside of the cylindrical base body in a substantially flowable state.

According to a second aspect of the present invention, there is provided an electrically conductive member including: a cylindrical base body; and electrically conductive powder sealed inside of the cylindrical base body so as not to fill the inner volume thereof to the full.

According to a third aspect of the present invention, there is provided an electrically conductive member including: a cylindrical base body; and electrically conductive powder sealed inside of the cylindrical base body at a fill fraction in the range of from 20 to 95% of the inner volume thereof.

According to a fourth aspect of the present invention, there is provided an electrically conductive member according to the first or second aspect, wherein the electrically conductive powder fills only from 20 to 95% of the inner volume of the cylindrical base body.

According to a fifth aspect of the present invention, there is provided an electrically conductive member according to any one of the first to third aspects, wherein a fill fraction of the electrically conductive powder is in the range of from 50 to 95% of the inner volume of the cylindrical base body.

According to a sixth aspect of the present invention, there is provided an electrically conductive member according to any one of the first to third aspects, wherein a fill fraction of the electrically conductive powder is in the range of from 70 to 90% of the inner volume of the cylindrical base body.

According to a seventh aspect of the present invention, there is provided an electrically conductive member according to any one of the first to sixth aspects, wherein a resistance value of the electrically conductive powder as a whole is in the range of from $10^{-8}$ to $10^{8}\Omega$.

According to an eighth aspect of the present invention, there is provided an electrically conductive member according to any one of the first to seventh aspects, wherein the electrically conductive powder is a mixture of different kinds of powder constituents and a resistance value of each of the powder constituents is in the range of from $10^{-8}$ to $10^{17}\Omega$.

According to a ninth aspect of the present invention, there is provided an electrically conductive member according to any one of the first to eighth aspects, wherein a number average particle diameter of the electrically conductive powder is in a range of from 10 $\mu$m to 1 mm.

According to a tenth aspect of the present invention, there is provided an electrically conductive member according to any one of the first to ninth aspects, wherein the cylindrical base body comprises a magnetic material.

According to an eleventh aspect of the present invention, there is provided an electrically conductive member according to any one of the first to tenth aspects, wherein the cylindrical base body is of a layered structure.

According to a twelfth aspect of the present invention, there is provided an electrically conductive member according to any one of the first to eleventh aspects, wherein the outer peripheral surface of the cylindrical base body comprises a deformable material which deforms due to weight of the electrically conductive powder and/or motion thereof.

According to a thirteenth aspect of the present invention, there is provided an electrically conductive member according to any one of the first to twelfth aspects, wherein the cylindrical base body is adapted for use as a roller.

According to a fourteenth aspect of the present invention, there is provided an electrically conductive member according to any one of the first to thirteenth aspects, further including a shaft passing through the cylindrical base body in an axial direction thereof and serving as a rotation axis thereof.

According to a fifteenth aspect of the present invention, there is provided an electrically conductive member according to the fourteenth aspect, wherein the shaft is fixed by flange members provided at both ends of the cylindrical base body.

According to a sixteenth aspect of the present invention, there is provided an electrically conductive member according to the fifteenth aspect, wherein the flange members are made of an elastic material.

According to a seventeenth aspect of the present invention, there is provided an electrically conductive member according to the sixteenth aspect, wherein the electrically conductive powder contains magnetic powder.

According to an eighteenth aspect of the present invention, there is provided an image forming apparatus including an electrically conductive member according to any one of the first to the seventeenth aspect.

According to a nineteenth aspect of the present invention, there is provided an image forming apparatus including: an image bearing member; and charging means contacting the image bearing member to charge a surface of the image bearing member, wherein the charging means comprises an electrically conductive member including: a cylindrical base body; and electrically conductive powder sealed inside of the cylindrical base body in a substantially flowable state.

According to a twentieth aspect of the present invention, there is provided an image forming apparatus including: an image bearing member; and charging means contacting the image bearing member to charge a surface of the image bearing member, wherein the charging means comprises an electrically conductive member including: a cylindrical base body; and electrically conductive powder sealed inside of the cylindrical base body so as not to fill the inner volume thereof to the full.

According to a twenty-first aspect of the present invention, there is provided an image forming apparatus including: an image bearing member; and charging means contacting the image bearing member to charge a surface of the image bearing member, wherein the charging means comprises an electrically conductive member including: a cylindrical base body; and electrically conductive powder sealed inside of the cylindrical base body at a fill fraction in the range of from 20 to 95% of the inner volume thereof.

According to a twenty-second aspect of the present invention, there is provided an image forming apparatus according to any one of the nineteenth to twenty-first aspects, wherein the charging means is means applying a bias of a DC voltage or a bias generated by superimposing AC voltage on a DC voltage.

According to a twenty-third aspect of the present invention, there is provided an image forming apparatus according to any one of the nineteenth to twenty-second aspects, wherein the image bearing member and the electrically conductive member are relatively rotated about respective axes thereof by providing a differential peripheral speed therebetween.

According to a twenty-fourth aspect of the present invention, there is provided an image forming apparatus including: an image bearing member; and transfer means contacting the image bearing member to transfer a toner image on a surface thereof onto a transfer substrate, wherein the transfer means comprises an electrically conductive member including: a cylindrical base body; and electrically conductive powder sealed inside of the cylindrical base body in a substantially flowable state.

According to a twenty-fifth aspect of the present invention, there is provided an image forming apparatus including: an image bearing member; and transfer means contacting the image bearing member to transfer a toner image on a surface thereof onto a transfer substrate, wherein the transfer means comprises an electrically conductive member including: a cylindrical base body; and electrically conductive powder sealed inside of the cylindrical base body so as not to fill the inner volume thereof to the full.

According to a twenty-sixth aspect of the present invention, there is provided an image forming apparatus including: an image bearing member; and transfer means contacting the image bearing member to transfer a toner image on a surface thereof onto a transfer substrate, wherein the transfer means comprises an electrically conductive member including a cylindrical base body; and electrically conductive powder sealed inside of the cylindrical base body at a fill fraction in the range of from 20 to 95% of the inner volume thereof.

According to a twenty-seventh aspect of the present invention, there is provided an image forming apparatus according to any one of the twenty-fourth to twenty-sixth aspects, wherein the image bearing member and the electrically conductive member are relatively rotated about respective axes thereof by providing a differential peripheral speed therebetween.

According to a twenty-eighth aspect of the present invention, there is provided an image forming apparatus including: an image bearing member; charging means contacting the image bearing member to charge a surface thereof; first transfer means contacting the image bearing member to transfer a toner image on the surface thereof to an intermediate transfer member; and second transfer means contacting the intermediate transfer member to transfer a toner image on a surface thereof to a transfer substrate, wherein at least one of the charging means, the first transfer means and the second transfer means comprises an electrically conductive member including: a cylindrical base body; and electrically conductive powder sealed inside of the cylindrical base body in a substantially flowable state.

According to a twenty-ninth aspect of the present invention, there is provided an image forming apparatus including: an image bearing member; charging means contacting the image bearing member to charge a surface thereof; first transfer means contacting the image bearing member to transfer a toner image on the surface thereof to an intermediate transfer member; and second transfer means contacting the intermediate transfer member to transfer a toner image on a surface thereof to a transfer substrate, wherein at least one of the charging means, the first transfer means and the second transfer means comprises an electrically conductive member including: a cylindrical base body; and electrically conductive powder sealed inside of the cylindrical base body so as not to fill the inner volume thereof to the full.

According to a thirtieth aspect of the present invention, there is provided an image forming apparatus including: an image bearing member; charging means contacting the image bearing member to charge a surface thereof; first transfer means contacting the image bearing member to transfer a toner image on the surface thereof to an intermediate transfer member; and second transfer means contacting the intermediate transfer member to transfer a toner image on a surface thereof to a transfer substrate, wherein at least one of the charging means, the first transfer means and the second transfer means comprises an electrically conductive member including a cylindrical base body; and electrically conductive powder sealed inside of the cylindrical base body at a fill fraction in the range of from 20 to 95% of the inner volume thereof.

According to a thirty-first aspect of the present invention, there is provided an image forming apparatus including: an image bearing member; charging means contacting the image bearing member to charge a surface thereof; first transfer means contacting the image bearing member to transfer a toner image on the surface thereof to an intermediate transfer member; and second transfer means contacting the intermediate transfer member to transfer a toner image on a surface thereof to a transfer substrate, wherein at least one of the charging means, the first transfer means and the second transfer means comprises an electrically conductive member including: a cylindrical base body; and electrically conductive powder sealed inside of the cylindrical base body in a substantially flowable state and the electrically conductive powder includes magnetic powder, the image forming apparatus further including: magnetic field forming means forming a magnetic field in which the electrically conductive powder is attracted to the image bearing member or the intermediate transfer member.

According to a thirty-second aspect of the present invention, there is provided an image forming apparatus including: an image bearing member; charging means contacting the image bearing member to charge a surface thereof; first transfer means contacting the image bearing member to transfer a toner image on the surface thereof to an intermediate transfer member; and second transfer means contacting the intermediate transfer member to transfer a toner image on a surface thereof to a transfer substrate, wherein at least one of the charging means, the first transfer means and the second transfer means comprises an electrically conductive member including: a cylindrical base body; and electrically conductive powder sealed inside of the cylindrical base body so as not to fill the inner volume thereof to the full and the electrically conductive powder includes magnetic powder, the image forming apparatus further including: magnetic field forming means forming a magnetic field in which the electrically conductive powder is attracted to the image bearing member or the intermediate transfer member.

According to a thirty-third aspect of the present invention, there is provided an image forming apparatus including: an image bearing member; charging means contacting the image bearing member to charge a surface thereof; first transfer means contacting the image bearing member to transfer a toner image on the surface thereof to an intermediate transfer member; and second transfer means contacting the intermediate transfer member to transfer a toner image on a surface thereof to a transfer substrate, wherein at least one of the charging means, the first transfer means and the second transfer means comprises an electrically conductive member including a cylindrical base body; and electrically conductive powder sealed inside of the cylindrical base body at a fill fraction in the range of from 20 to 95% of the inner volume thereof and the electrically conductive powder includes magnetic powder, the image forming apparatus further including: magnetic field forming means forming a magnetic field in which the electrically conductive powder is attracted to the image bearing member or the intermediate transfer member.

According to a thirty-fourth aspect of the present invention, there is provided an image forming apparatus according to any one of the thirty-first to thirty-third aspects, wherein the magnetic field forming means is a film having magnetism provided on an inner peripheral surface of the image bearing member or the intermediate transfer member.

According to a thirty-fifth aspect of the present invention, there is provided an image forming apparatus according to any one of the thirty-first to thirty-third aspects, wherein the magnetic field forming means is a magnetic force generating member provided at a position opposite the electrically conductive member on an inner peripheral section of the image bearing member or the intermediate transfer member.

According to a thirty-sixth aspect of the present invention, there is provided an image forming apparatus according to any one of the thirty-first to thirty-third aspects, wherein the image bearing member or the intermediate transfer member includes a base body made of a magnetic material and the magnetic field forming means is the base body.

According to a thirty-seventh aspect of the present invention, there is provided an image forming apparatus including: an image bearing member; first transfer means contacting the image bearing member to transfer a toner image on the surface thereof to an intermediate transfer member in the shape of an endless belt; and second transfer means contacting the intermediate transfer member to transfer a toner image on a surface thereof to a transfer substrate, wherein the second transfer means is an electrically conductive member including: a cylindrical base body; and electrically conductive powder sealed inside of the cylindrical base body in a substantially flowable state and the electrically conductive powder includes magnetic powder, the image forming apparatus further including: magnetic field forming means forming a magnetic field in which the electrically conductive powder is attracted to a support member provided at a position opposite the second transfer means on an inner peripheral section of the intermediate transfer member.

According to a thirty-eighth aspect of the present invention, there is provided an image forming apparatus including: an image bearing member; first transfer means contacting the image bearing member to transfer a toner image on the surface thereof to an intermediate transfer member in the shape of an endless belt; and second transfer means contacting the intermediate transfer member to transfer a toner image on a surface thereof to a transfer substrate, wherein the second transfer means comprises an electrically conductive member including: a cylindrical base body; and electrically conductive powder sealed inside of the cylindrical base body so as not to fill the inner volume thereof to the full and the electrically conductive powder includes magnetic powder, the image forming apparatus further including: magnetic field forming means forming a magnetic field in which the electrically conductive powder is attracted to a support member provided at a position opposite the second transfer means on an inner peripheral section of the intermediate transfer member.

According to a thirty-ninth aspect of the present invention, there is provided an image forming apparatus including: an image bearing member; first transfer means contacting the image bearing member to transfer a toner image on the surface thereof to an intermediate transfer member in the shape of an endless belt; and second transfer means contacting the intermediate transfer member to transfer a toner image on a surface thereof to a transfer substrate, wherein the second transfer means comprises an electrically conductive member including a cylindrical base body; and electrically conductive powder sealed inside of the cylindrical base body at a fill fraction in the range of from 20 to 95% of the inner volume thereof and the electrically conductive powder includes magnetic powder, the image forming apparatus further including: magnetic field forming means forming a magnetic field in which the electrically conductive powder is attracted to a support member provided at a position opposite the second transfer means on an inner peripheral section of the intermediate transfer member.

BRIEF DESCRIPTION OF THE DRAWINGS

FIG. 3 is a sectional view showing a way of deformation of a cylindrical base body caused by electrically conductive powder.

FIG. 4 is a schematic sectional views showing an illustrative embodiment of a positional relationship between an image bearing member and an electrically conductive member.

DESCRIPTION OF THE PREFERRED EMBODIMENT

Description will be given of an electrically conductive member and an image forming apparatus equipped with the electrically conductive member of the present invention below with reference to the accompanying drawings.

Here, an electrical conductive member of the present invention means an electrically conductive or a semiconductive member (hereinafter collectively referred to as an electrically conductive member) used as, for example, charging means, transfer means, first transfer means and second transfer means in an intermediate transfer method, electrostatic erasing means and the like, and a shape thereof may be like either a roller or a belt. Such an electrically conductive member contacts a photosensitive member as an image bearing member, an intermediate transfer member or a support member disposed oppositely to enable a desired nip to be formed. Here, the photosensitive member, the intermediate transfer member or the support member may be formed in the shape of a drum or a belt.

An electrically conductive member as a first aspect of the present invention includes: a cylindrical base body; and electrically conductive powder sealed inside of the cylindrical base body in a substantially flowable state.

An electrically conductive member as a second aspect of the present invention includes: a cylindrical base body; and electrically conductive powder sealed inside of the cylindrical base body so as not to fill the inner volume thereof to the full.

An electrically conductive member as a third aspect of the present invention includes: a cylindrical base body; and electrically conductive powder sealed inside of the cylindrical base body at a fill fraction in the range of from 20 to 95% of the inner volume thereof.

In such a way, an electrically conductive member of the present invention essentially includes a cylindrical base body and an electrically conductive powder.

Illustrative embodiments are below shown of an electrically conductive member of the present invention, which are detailed.

Electrically Conductive Member

Figure 1:
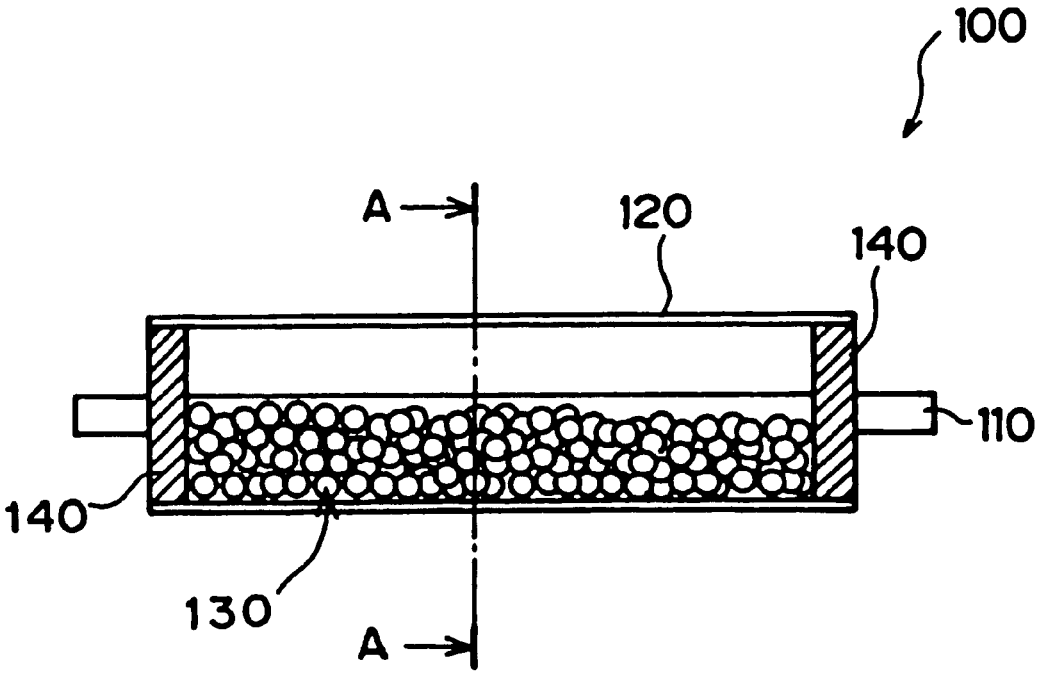
FIG. 1 is a longitudinal sectional view for describing a structure of an electrically conductive member as an illustrative embodiment of the present invention.
Figure 2A:
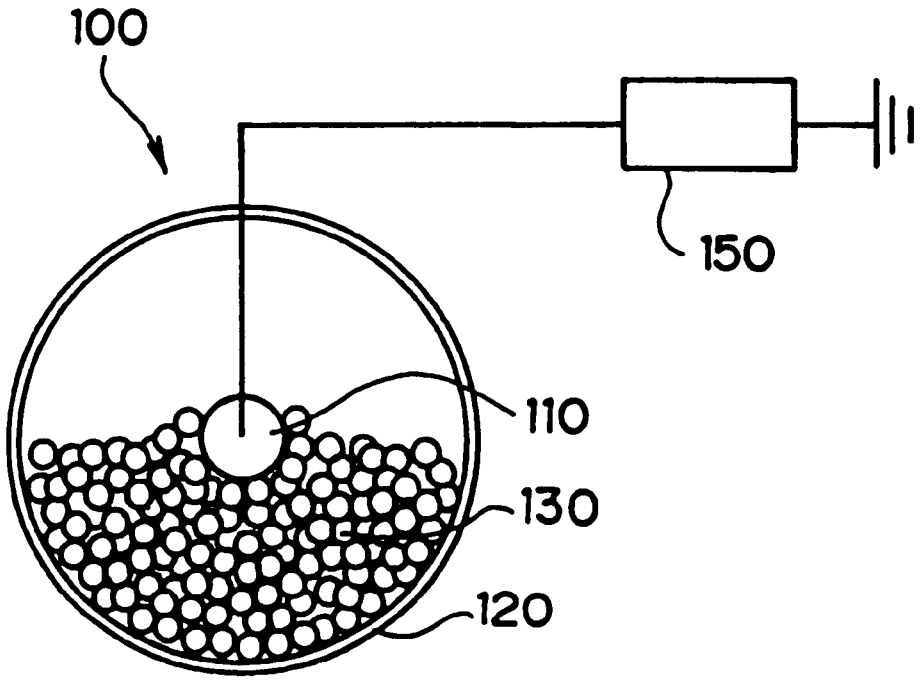
FIG. 2A is a sectional view taken on line A—A of the electrically conductive member as an illustrative embodiment of the present invention shown in FIG. 1, showing a state where a fill fraction of electrically conductive powder is at 50%.
Figure 2B:
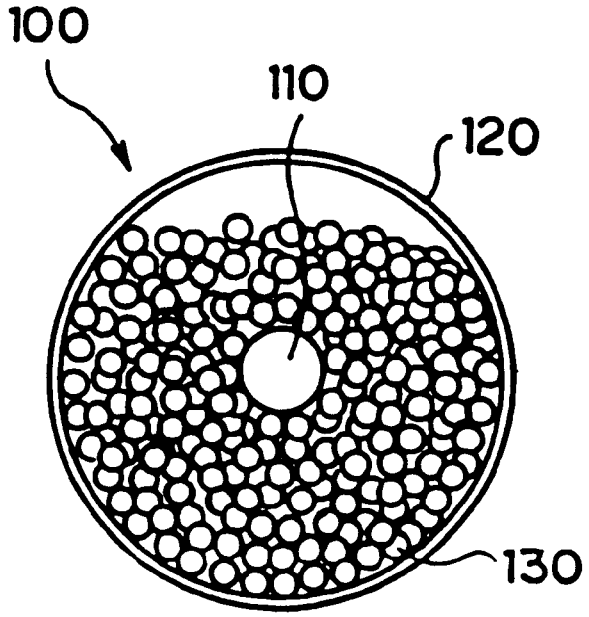
FIG. 2B is a sectional view taken on line A—A of the electrically conductive member as an illustrative embodiment of the present invention shown in FIG. 1, showing a state where a fill fraction of electrically conductive powder is at 80%.

Referring to FIGS. 1 to 3, detailed description will be given of an electrically conductive member as an illustrative embodiment of the present invention below. Here, FIG. 1 is a longitudinal sectional view for describing a structure of an electrically conductive member as an illustrative embodiment of the present invention. FIGS. 2(*a*) and 2(*b*) are both sectional views taken on line A—A of the electrically conductive member as an illustrative embodiment of the present invention shown in FIG. 1, wherein FIG. 2A shows a state where a fill fraction of electrically conductive powder is at 50% and FIG. 2B shows a state where a fill fraction of electrically conductive powder is at 80%. Moreover, FIG. 3 is a sectional view showing a way of deformation of a cylindrical base body caused by electrically conductive powder.

As shown in FIG. 1, while an electrically conductive member 100 as an illustrative embodiment of the present invention includes: a metal shaft 110; a cylindrical base body 120; an electrically conductive powder 130; and flange members 140, an electrically conductive member of the present invention is not limited to such a structure. Moreover, as shown in FIG. 2A, an electrically conductive member 100 of the present invention is connected to an external power supply 150 through the metal shaft 110.

The metal shaft 110 is made of, for example, SUS, SUM or the like and passes through the cylindrical base body 120 in an axial direction thereof to function as a rotation axis of the electrical conductive member 100. Moreover, the external power supply 150 is, as shown in FIG. 2A, connected to the metal shaft 110 to apply a desired bias thereto; therefore, the metal shaft 110 functions as voltage applying means to the electrically conductive member 100 in cooperation with the external power supply 150.

The cylindrical base body 120 may be either like a roller or a belt and is, to be particular, a seamless tube, and endless belt or the like, for example. In addition, preferably, the cylindrical base body 120 can be freely deformed according to a weight or a motion of the electrically conductive powder 130 contained in the cylindrical base body 120 in a sealed state.

As binder materials constituting the cylindrical base body 120, the following materials are exemplified:

rubber materials such as SBR (styrene butadiene rubber), BR (polybutadiene rubber), Hi styrene rubber (Hi Styrene resin masterbatch), IR (isoprene rubber), IIR (butyl rubber), halogenated butyl rubber, NBR (nitrile butadiene rubber), hydrogenated NBR (H-NBR) EPDM, EPM (ethylene propylene rubber), NBR/EPDM blend, CR (chloroprene rubber), ACM (acrylic rubber), CO (hydrin rubber), ECO (epichlorohydrin), chlorinated polyethylene (chlorinated-PE), VAMAC (ethylene-acrylic rubber), VMQ (silicone rubber), U (urethane rubber), FKM (fluororubber), NR (natural rubber), CSM (chlorosulfonated polyethylene rubber) and the like;

resin materials such as polyvinyl chloride (PVC), polyethylene, polypropylene, polystyrene, polyester, polyurethane, polyamide, polyimide, nylon, ethylene vinyl acetate, ethylene ethyl acrylate, ethylene methyl acrylate, styrene butadiene, polyarylate, polycarbonate, Teflon (R), silicone, polymethacrylate, polybutyl methacrylate, polyvinyl acetate, polyvinyl butyral, polyacrylic resin, rosin, modified rosin, terpene resin, phenol resin and the like;

styrene-base copolymers such as styrene-propylene copolymer, styrene-vinyltoluene copolymer, styrene-vinylnaphthalene copolymer, styrene-methylacrylate copolymer, styrene-ethylacrylate copolymer, styrene-butylacrylate copolymer, styrene-octylacrylate copolymer, styrene-dimethylaminoethyl acrylate copolymer, styrene-methylmethacrylate copolymer, styrene-ethylmethacrylate copolymer, styrene-butylmethacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene butadiene copolymer, styrene-isoprene copolymer, styrene-maleic anhydride copolymer, styrene-maleic ester copolymer and the like; and in addition, aliphatic or alicyclic hydrocarbon resins, aromatic petroleum resins, paraffin wax, carnauba wax and the like, mixtures thereof, copolymers thereof and modified resins thereof, to which the binder materials are not specifically limited.

Binder materials described above may be used singly or in a mixture of two or more kinds, and moreover, in the form of a copolymer or a modified derivative thereof.

As the binder materials, preferably they are selected from binder materials including no component which results in precipitation or, as is generally called, bleeding of a low molecular component, a plasticizer or the like on a surface of an electrically conductive member, or alternatively, binder materials having received an antibleeding treatment, so as not to exert adverse influences such as contamination against an image bearing member and an intermediate transfer member.

Moreover, the cylindrical base body 120 receives adjustment of its resistance (electrical resistance) value in a predetermined range of, for example, from $10^4$ to $10^{10}\Omega$ by mixing an electrically conductive material into a binder material of the above various binder materials. In the present invention, a resistance value of the cylindrical base body 120 is obtained in the following way:

A metal shaft having an outer diameter same as an inner diameter of a cylindrical base body 120 is inserted into the interior of the cylindrical base body 120. Then, a metal flat plate is brought into contact with the outer peripheral surface of the cylindrical base body 120. Thereafter, a predetermined DC voltage is applied to the metal shaft to measure a current flowing between the metal shaft and the metal plate. In such a measurement, a resistance value of the cylindrical base body 120 can be calculated from the applied voltage and the current flowing therebetween.

As electrically conductive materials, the following materials are exemplified: carbon powder such as carbon black, graphite; mixtures of magnetic powder, metal powder such as that of tin, iron, copper with a resin; metal fibers; metal oxides such as zinc oxide, tin oxide, titanium oxide; metal sulfides such as copper sulfide and zinc sulfide; so-called hard ferrites such as those of strontium, barium and rare earth metals; magnetite; ferrites such as those of copper, zinc, nickel and manganese; and the above materials whose surfaces have received a conduction treatment; oxides, hydroxides, carbonates or intermetallic compounds including different metal elements combined, selected from the group of consisting of copper, iron, manganese, nickel, zinc, cobalt, barium, aluminum, tin, lithium, magnesium, silicon and the like; solid solutions of metal oxides obtained through burning in high temperatures, so-called composite metal oxides, to which the electrically conductive materials are not specifically limited. The following may be added: ion conductive agents such as quaternary ammonium salts and metal-substituted derivatives thereof. The above electrically conductive materials may be used either singly or in a mixture of two or more kinds.

Figure 9:
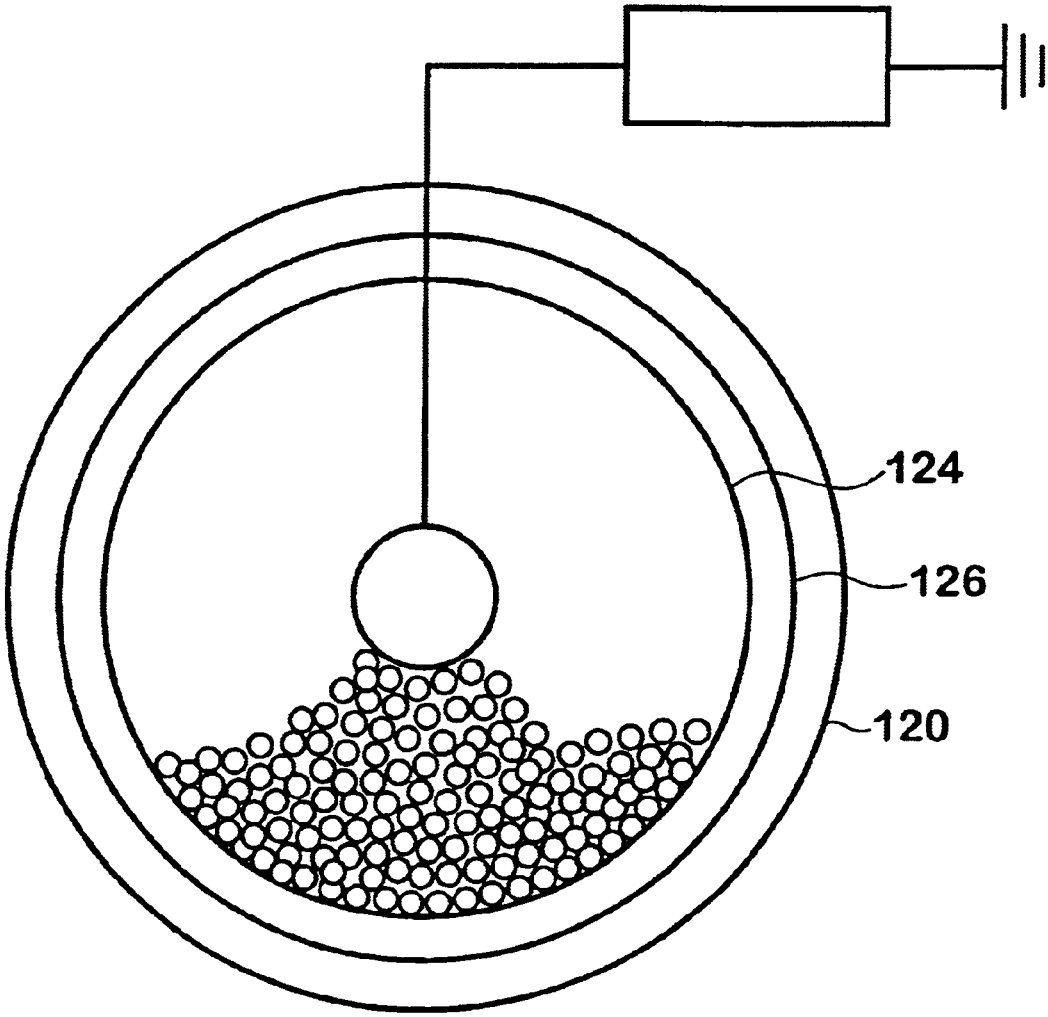
FIG. 9 is a sectional view showing the layered structure for the cylindrical base body.

The cylindrical base body 120 may be made of a layered structure, as shown in FIG. 9, and layers thereof 124 and 126, may be of the same material as each other or of respectively different materials from each other. In a case where a cylindrical base body 120 is of a stacked structure constituted of different materials in its layers as well, a resistance value of each layer is preferably adjusted in the above predetermined range.

A surface smoothness of the cylindrical base body 120 is preferably 15 μm or less, more preferably 10 μm or less and particularly preferably 8 μm or less in ten-point mean roughness (Rz). In a case where a ten-point mean roughness (Rz) is more than 15 μm, discharge is concentrated to projections present on the surface, leading to causes spot-like image defects, in some cases.

Here, a ten-point mean roughness (Rz) is a value obtained in a procedure that a reference length is extracted from a roughness curve in a direction of a mean line; altitudes are measured in a direction of vertical magnification from the mean line across the extracted region; and the sum of a mean value obtained from the absolute values of five altitudes (Yp), from the highest to the 5th highest, and a mean value obtained from the absolute values of five depths (Yv), from the lowest to the 5th lowest, are obtained, which are converted to values in micrometer units (μm) as a ten-point mean roughness (Rz).

A hardness of the cylindrical base body 120 is not only affected by a mass of an electrically conductive powder 130 contained in the interior of the cylindrical base body 120 in a sealed state and a fill fraction of the powder 130, but also adjusted properly according to an installment method and an application; therefore, though not specifically limited, a hardness is preferably in the range of 10 to 90° degrees and more preferably in the range of from 20 to 70° degrees on Asker-C hardness scale.

In a case where a cylindrical base body 120 high in hardness and rigidity is used, it is also possible that a cylindrical base body 120 (an electrically conductive member 100) and a photosensitive member or an intermediate transfer member are disposed with a predetermined clearance therebetween in a non-contact state, in the image forming apparatus.

A thickness of a cylindrical base body 120 is arbitrarily set based on a hardness of a layer with a predetermined resistance value adjusted by a selected combination of a binder material and an electrically conductive material described above, as well as on a pressure resistance (a thickness endurable against pin-hole leakage).

Moreover, a cylindrical base body 120 may be formed so as to assume magnetism by mixing a magnetic material into one of various kinds of binder materials described above.

As magnetic materials in use, the following are preferably exemplified: so-called hard ferrites such as those of strontium, barium and rare earth metals; magnetite; ferrites such as those of copper, zinc, nickel, manganese and the like, or the materials whose surfaces have received a conduction treatment, wherein the above magnetic materials are used singly and in mixtures of two or more kinds.

A cylindrical base body 120 can be provided with a surface layer excellent in release characteristics and anti-bleeding on the outer peripheral surface thereof as needed. As a surface layer at that time, it is preferable to properly select a material having a flexibility so as to be able to follow deformation of a cylindrical base body 120 and being excellent in release characteristics to some extent. Moreover, it is also desirable to use a coating method excellent in film thickness uniformity such as a spray coating method or a dipping method.

A cylindrical base body 120 is molded using a binder material described above by means of a extrusion molding method, a coextrusion molding method, an injection molding method, a pressure molding method, an injection blow molding method, a vacuum molding method and the like. Moreover, a seamless tube on the market may be used.

An electrically conductive powder 130 is, as shown in FIGS. 2(*a*) and 2(*b*), (1) sealed in the interior of a cylindrical base body 120 so as not fill the inner volume to the full, (2) sealed in the interior of the cylindrical base body 120 in a substantially flowable state, or (3) sealed in the interior of the sealed cylindrical base body 120 at a fill fraction in the range of from 20 to 95%.

That is, an electrical conductive member 100 of the present invention is used in a state where the interior of the cylindrical base body 120 is occupied by a clearance or a free space and an electrically conductive powder 130.

Since an electrically conductive member 100 of the present invention is used in such a state, the electrically conductive material 130 moves simultaneously as the cylindrical base body 120 rotates to strike the inner wall of the cylindrical base body 120 and to vibrate the cylindrical base body 120; therefore, toner, paper powder and the like attached on the surface of the cylindrical base body 120 can be forced to fall off by the vibrations, thereby enabling maintenance of a good resistance uniformity and a good surface smoothness. Moreover, by motion of the electrically conductive powder 130 sealed in the cylindrical base body 120, the cylindrical base body 120 keeps in contact at all times with an image bearing member (or an intermediate transfer member) under a constant load, which enables a uniform nip to be kept for a long time. Note that by varying conditions including a fill fraction of the electrically conductive powder 130 and a press level of the electrically conductive member 100, a nip can be adjusted on a nip width and a nip pressure at proper values.

Moreover, since an electrically conductive member 100 of the present invention is used in such circumstances, a uniform nip can be formed irrespective of a kind of material of a cylindrical base body 120. Therefore, since the use of a rubber material whose physical properties vary with ease according to a change in environment, as in a prior art practice, can be decreased, reduction can be realized in contamination or denaturing of an image bearing member (or an intermediate transfer member) caused by seeping out of a component contained in the bulk of the cylindrical base body 120 onto or by precipitation of the component on the surface thereof.

In a case where an electrically conductive member 100 of the present invention is used as a charging means (a charging roller) in an image forming apparatus, a charging sound can be reduced small even if a bias obtained by superimposing a high frequency AC bias to a DC bias is applied since the electrically conductive powder 130 sealed inside thereof prevents propagation of vibrations by its characteristics as powder.

Moreover, as described above, since an electrically conductive member 100 of the present invention has a high surface smoothness and in addition, is excellent in resistance uniformity, the use as a charging means (a charging roller) in an image forming apparatus enables DC charging by application of only a DC bias, thereby enabling a great reduction to be realized in etching phenomenon produced on the surface of an image bearing member (an intermediate transfer member or the like).

As a fill fraction of an electrically conductive power 130, a value is preferably in the range of from 20 to 95%, more preferably in the range of from 50 to 95% and particularly preferably in the range of from 70 to 90%.

In a case where a fill fraction is less than 20%, an effect of causing contaminants attached on the outer peripheral surface of a cylindrical base body 120 to fall off is hard to be obtained when an electrical conductive powder 130 moves in the interior of the cylindrical base body 120 by rotation of a electrically conductive member 100 since a total amount of the electrically conductive powder 130 is small. Moreover, in this case, since there is present much of a clearance (an air layer) in which the air contracts or expands in company with a change in environment, an influence can be exerted on a shape of the cylindrical base body 120. On the other hand, in a case where a fill fraction is more than 95%, a degree of freedom in nip formation tends to decrease due to reduction in a flowability of the electrically conductive powder 130.

Moreover, an electrically conductive member 100 as an illustrative embodiment of the present invention is equipped with the metal shaft 110 having a function of applying a voltage as a central shaft of a cylindrical base body 120; therefore, a case arises where no bias current can flow into an electrically conductive powder since no contact of the electrically conductive powder 130 occurs with the metal shaft 110 if a fill fraction is less than 50%. In such a case, measures can be available; for example, to displace an installment position of the metal shaft 110 from the rotation axis, or to provide electrically conductive vanes (stirring vanes) facilitating electrical conductance therethrough on the outer peripheral surface of the metal shaft 110, thereby enabling electrical conductance between the metal shaft 110 and the electrically conductive powder 130.

Here, a fill fraction of the present invention is calculated in such a way that measurement is performed in advance on a mass of an electrically conductive powder 130 at a fill fraction of 100% filling a volume remaining after excluding a volume of a metal shaft included inside of a cylindrical base body 120 in use from the total inner volume the cylindrical base body 120, on the basis of which the fill fraction is calculated. A mass, in a case of a fill fraction of 100%, of an electrically conductive powder 130, is obtained in a procedure including the steps of: preparing a vessel with a volume, the volume being the same as that of the cylindrical base body 120 from which a volume of a metal shaft 110 actually used inside the cylindrical base body 120 has been subtracted; filling the vessel with the electrically conductive powder, by weak vibrations for one minute, for example, to the densest filling level; and thereafter, measuring an increase in mass to determine the mass of the electrically conductive powder 120. Therefore, for example, a mass of an electrically conductive powder 130 in a case of a fill fraction of 100% is 10 g, 8 g of an electrically conductive powder 130 contained in the cylindrical base body 120 in a sealed state is calculated to be a fill fraction of 80%.

An electrically conductive powder 130 can deform a shape of a cylindrical base body 120 by at least its weight as shown in FIG. 3 if the cylindrical base body 120 can be deformed (i.e., in a case where a hardness is low). Since as shown in FIG. 3, the electrically conductive powder 130 gathers in the lowest part of the cylindrical base body 120 by its weight, the cylindrical base body 120 is deformed. Hence, when an electrical conductive member 100 is brought into contact with, for example, an image bearing member by using such deformation, the cylindrical base body 120 is deformed in conformity with a profile of a shape of the image bearing member to enable a nip to be formed. At this time, no necessity arises for excessively pressing the electrically conductive member 100 against the image bearing member as would be done in a prior art practice; therefore, it is reduced with ease that a component contained in the bulk of the cylindrical base body 120 seeps out or precipitates onto the surface thereof. Therefore, it becomes possible to prevent denaturation or contamination of an image bearing member from occurring.

A resistance value (electrical resistance value) of an electrically conductive powder 130 as a whole is preferably in the range of from $10^{-8}$ to $10^{8}\Omega$, more preferably in the range of from $10^{-5}$ to $10^{6}\Omega$ and particularly preferably in the range of from $10^{-3}$ to $10^{4}\Omega$. If a resistance value is lower than the lower limits, a case arises where a resistance value required as an electrically conductive member 100 cannot be obtained. On the other hand, if a resistance value is higher than the highest limit, a case arises where a sufficient conductance is hard to obtained between a metal shaft 110 and a cylindrical base member 120.

An electrically conductive powder 130 may be constituted of either one kind of powder or two or more kinds of powder. In a case of a mixture of electrically conductive powder, a resistance value of each of constituents in use can be selected in the range of $1\times10^{-8}$ to $1\times10^{17}\Omega$. In this case, it is preferable that a resistance value of an electrically conductive powder 130 as a whole is adjusted in the above ranges as described above.

As electrically conductive powder 130, the following are exemplified: magnetic powder, metal powder such as that of tin, iron, copper and aluminum, and mixtures thereof with resin; metal fibers, metal oxides such as zinc oxide, tin oxide and titanium oxide; metal sulfides such as copper sulfide and zinc sulfide; carbon powder such as carbon black and graphite; so-called hard ferrites of strontium, barium, rare earth metals and the like; magnetite; ferrites of copper, zinc, nickel, manganese and the like, and the above materials whose surfaces have received a conduction treatment; oxides, hydroxides, carbonates or intermetallic compounds including different metal elements combined, selected from the group of consisting of copper, iron, manganese, nickel, zinc, cobalt, barium, aluminum, tin, lithium, magnesium, silicon and the like; solid solutions of metal oxides obtained through burning in high temperatures, in other words composite metal oxides. Moreover, the following are added: insulating powder such as ceramic powder, glass beads, latex particles, natural stone, pulverized stone, sands and the like. The above powder may be used either singly or in a mixture of two or more kinds as far as a resistance value of electrically conductive powder 130 as a whole meets a condition for a resistance value.

In the present invention, a resistance value of each of powder constituents constituting electrically conductive powder 130 is obtained in the following way:

A cylindrical holder is constituted of the top and bottom faces of metal, and the body section of an insulating material (sizes of the top and bottom faces being both a diameter 10 mmϕ and a height being 10 mm) and is filled with powder as measurement specimen and a voltage of 100 V is applied thereto in a compressed state under a pressure of 98 kPa (10 kg/cm$^2$). When a current value flowing through the powder is measured, a resistance value is calculated.

Moreover, if electrically conductive powder 130 is constituted of one kind of powder, a resistance value of the one kind of powder is a resistance value of the electrically conductive powder 130 as a whole without any change therein. On the other hand, if electrically conductive powder 130 is constituted of plural kinds of powder, a resistance value as obtained according to a measurement method similar to the above description on powder in which the plural kinds of powder have been sufficiently stirred and mixed is a resistance value of the electrically conductive powder 130 as a whole.

A number average particle diameter of electrically conductive powder 130 is preferably in the range of from $10^{-5}$ $\mu$m to 1 mm, more preferably in the range of from 5 to 700 $\mu$m and particularly preferably in the range of 40 to 300 $\mu$m. In a case where a number average particle diameter is less than the lower limits, a case arises where a flowability of powder is reduced, while in a case where a number average particle diameter is more than the upper limits, contact points between particles are reduced and thereby, conduction circuits are insufficient, leading to a case where spotty irregularities arise in conductivity on the surface of an electrically conductive member 100.

Magnetic powder may be included in an electrically conductive powder 130. In a case where magnetic powder is included, by using magnetism of the powder, a position of an electrically conductive member 100 can be set in various ways. For example, as shown in FIG. 4, an electrically conductive member 100 may be brought into contact with an image bearing member 160 at the lower side thereof to form a nip. Here, FIG. 4 is a schematic sectional views showing an illustrative embodiment of a positional relationship between an image bearing carrier 160 and an electrically conductive member 100.

As shown in FIG. 4, if a magnetic force generating member (a magnetic field forming means) 170*a* such as spherical magnet or the like is placed on the inner peripheral section of an image bearing member 160 to form a magnetic field attracting electrically conductive powder 130, and if magnetic powder is contained in the electrically conductive powder 130, the electrically conductive powder 130 is attracted to the magnetic field generating member 170*a* to move in a direction opposite the gravitational direction and deform a cylindrical base body 120 so as to enable a nip to be formed between the cylindrical base body 120 and an image bearing member 160. In this situation, as described above, if the cylindrical base body 120 itself has magnetism, magnetism on the surface thereof is kept constant and motion of the electrically conductive powder 130 accompanying revolution of the electrically conductive member 100 becomes more uniform, with the result that a nip formed between the electrically conductive member 100 of the present invention and the image bearing member 160 are retained constant for a long period.

Figure 5A:
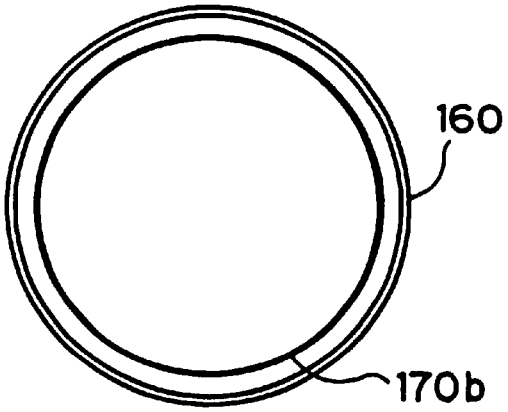
FIGS. 5A and 5B are sectional views showing structures of image bearing members preferably used for an electrically conductive member of the present invention.
Figure 5B:
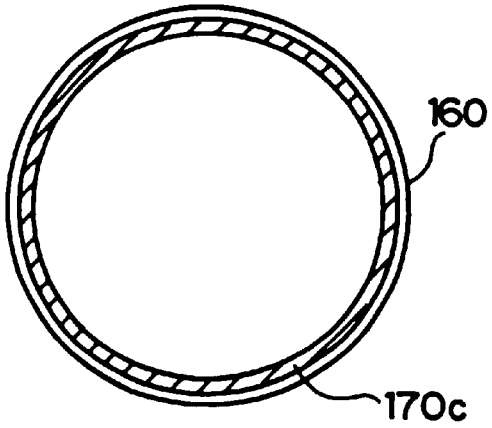

Magnetic field forming means may be, as shown in FIG. 4, constituted of the magnetic force generating member 170*a* such as a spherical magnet or the like disposed at a position opposite the electrically conductive member 100 on the inner peripheral section of the image bearing member 160, or alternatively, as shown in FIG. 5A, constituted of a film 170*b* having magnetism lined on all of the inner peripheral surface of an image bearing member 160. Moreover, as shown in FIG. 5B, a base body 170*c* of the image bearing member 160 itself may be made of a material having magnetism such as iron or an alloy containing iron to function as magnetic field forming means. Here, FIGS. 5A and 5(*b*) are sectional views showing structures of the image bearing members 160 preferably used for the electrically conductive member 100 of the present invention.

Note that the image bearing member 160 shown in FIG. 4 may be an intermediate transfer in the shape of a drum in an intermediate transfer method. In this case, similarly, by installing magnetic field forming means inside of an intermediate transfer member, a nip can be formed between a second transfer roller constituted of a electrically conductive member 100 of the present invention and the image bearing member 160.

Flange members 140 are provided on both ends of a cylindrical base body 120 and members to play a role not to leak out electrically conductive powder 130 contained in a sealed state. As materials to form the flange members 140, though not specially limited, preferable is an elastomer that can be deformed according to deformation of a cylindrical base member 120. As the elastomer, candidates are sponge, rubber, thermoplastic elastomer and the like and among them, sponge with a skin layer is most preferably used.

In a case where sponge with a skin layer is used as the flange members 140, flange members 140 with the skin layers are provided such that the skin layers face the interior of a cylindrical base member 120 and the skin layers are put into contact with electrically conductive powder 130, thereby enabling perfect prevention of leakage of the electrically conductive powder 130.

While description is given of an electrically conductive member 100 as an illustrative embodiment of the present invention, the structure thereof is not limited as described in the illustrative embodiment. For example, a function to rotate the electrically conductive member 100 is imparted thereto by using a member holding both ends of a cylindrical base body 120 so as to be rotatable. Another structure is allowed in which plural tension rolls are included inside of the electrically conductive member 100 to have a function to adjust a shape of the electrically conductive member 100 and furthermore part of the tension rolls has a function to apply a voltage. Still another structure is allowed in which as described above, vanes (stirring vanes) are provided on the outer peripheral surface of the metal shaft 110.

An electrically conductive member 100 of the present invention does not require a constant current control and an environmental control, thereby enabling great contribution to reduction in cost for production of an image apparatus since an electrically conductive powder 130 controls a current amount to the surface of an electrically conductive member 100 and causes no change in environment.

Moreover, in an electrically conductive member 100 of the present invention, since a pressure applied to a photosensitive member for forming a nip can be reduced, the rigidity necessitated by a prior art electrically conductive member for achieving a stability of a shape and preventing a deflection is no longer required. Therefore, down-sizing of a shaft and therefore, in company therewith, down-sizing of an electrically conductive member 100 itself can be achieved.

Moreover, since an electrically conductive member 100 of the present invention can vibrate a cylindrical base body by motions of an electrically conductive powder to thereby enable contaminants such as toner and paper powder attached on the surface of the cylindrical base body to fall off from the surface, installment of blades, a brush or the like can be omitted.

The electrically conductive members of the present invention can be preferably used for charging means, transfer means (including first and second transfer means both described later), in addition, electrostatic erasing means and the like with required adjustment in conditions such as electrical characteristics and surface characteristics properly thereof.

As described above, since an electrically conductive member of the present invention has no complex structure, the member can be produced with more of simplicity and convenience as compared with a prior art electrically conductive member (for example, a semiconductive roller) Therefore, an electrically conductive member of the present invention enables great reduction in cost to in turn, realize cost reduction for an image forming apparatus having the electrically conductive member.

Image Forming Apparatus

While there is shown below an example of an image forming apparatus with an electrically conductive member of the present invention (an image forming apparatus of the present invention), no specific limitation is imparted to the example. Note that description will be given of only a major part shown in the figure and the other parts are not described.

Figure 6:
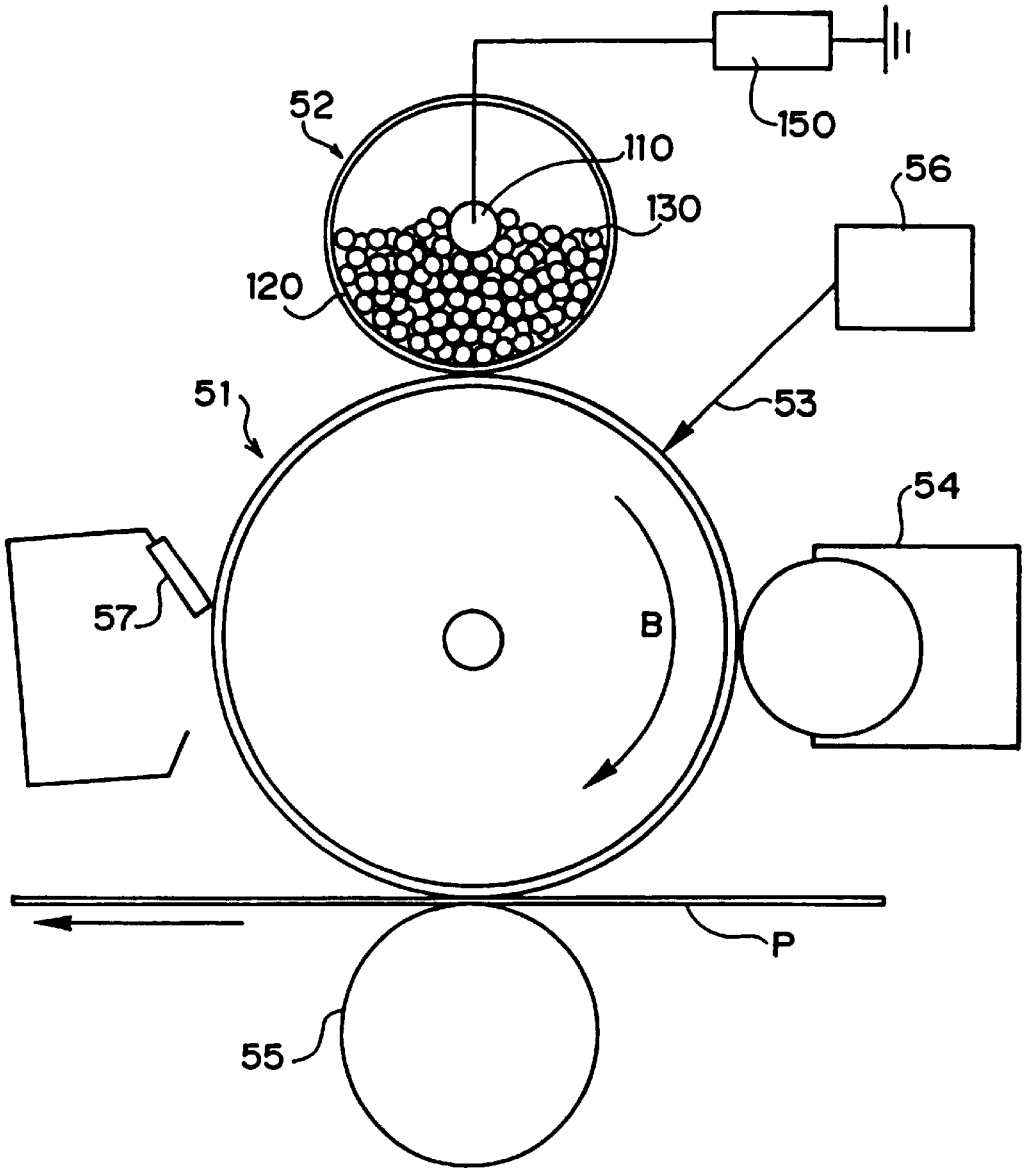
FIG. 6 is a schematic view of a construction showing an example of an image forming apparatus of the present invention.

FIG. 6 is a schematic view of a construction showing an example of an image forming apparatus of the present invention. The image forming apparatus shown in FIG. 6 includes: a photosensitive member (image bearing member) 51 rotating in a direction of an arrow B; a charging roller (charging means) 52 charging the surface of the photosensitive member 51 to a predetermined potential, disposed in the neighborhood of the photosensitive member 51; an exposure device (exposure means) 56 exposing the charged surface of the photosensitive member 51 with laser light 53 according to image signal to form a electrostatic latent image; a developing device (developing means) 54 feeding charged toner(developer) to develop the electrostatic latent image; a transfer roller (transfer means) 55 transferring a developed toner image onto a recording paper sheet (transfer substrate) P; and a cleaning unit 57 for removing toner remaining on the surface of the photosensitive member 51 after the transfer, these devices being sequentially configured. Here, in the image forming apparatus shown in FIG. 6, the electrically conductive member as described above of the present invention is used as the charging roller 52 and the same symbols as used in FIG. 2A are attached to respective constituents of the electrically conductive member.

First of all, the surface of the photosensitive member 51 is charged to a potential of the order in the range of from −600 V to −800 V by the charging roller 52. The photosensitive member 51 is of a structure formed by stacking a photosensitive layer on an electrically conductive base body. The photosensitive layer is usually of a high resistance value, but has a property to change a resistivity in a portion irradiated with the laser light 53 when the laser light 53 emitted from the exposure device 56 is directed to the photosensitive layer. Therefore, the laser light 53 is outputted, onto the surface of the charged surface of the photosensitive member 51, according to image data sent from a control unit not shown through the exposure device 56. The laser light 53 impinges on the photosensitive layer on the surface of the photosensitive member 51 to thereby form an electrostatic latent image of a printing pattern on the surface of the photosensitive member 51.

The electrostatic latent image formed on the surface of the photosensitive member 51 in such a way is revolved to a predetermined developing position by rotation of the photosensitive member 51 in the direction of the arrow B. Then, at the developing position, the electrostatic latent image on the photosensitive member 51 is transformed into a visual image (toner image) by the developing device 54.

By passing the surface of the photosensitive member 51 through the developing device 54, toner is electrostatically attached only on a discharged latent image section of the photosensitive member 51 to thereby, develop the latent image with toner. In succession, the photosensitive member 51 is rotated in the direction of the arrow B to transport a toner image developed on the surface of the photosensitive member 51 to a predetermined transfer position.

When the toner image on the surface of the photosensitive member 51 is transported to the transfer position, a predetermined transfer bias is applied to the transfer roller 55 and an electrostatic force directing from the photosensitive member 51 to the transfer roller 55 acts on the toner image to transfer the toner image on the surface of the photosensitive member 51 onto the recording paper sheet P. Residual toner on the surface of the photosensitive member 51 is removed therefrom by the cleaning unit 57.

According to the image forming apparatus shown in FIG. 6, an electrically conductive member of the present invention is used as the charging roller 52; therefore a charging sound can be reduced small even if a bias obtained by superimposing a high frequency AC bias to a DC bias is applied since the electrically conductive powder 130 put inside thereof in a sealed state prevents propagation of vibrations by its characteristics as powder.

Moreover, as described above, an electrically conductive member of the present invention can force contaminants such as toner, paper powder and the like attached on the surface of the cylindrical base body 120 to fall off therefrom; therefore, high surface smoothness and excellency in resistivity uniformity on the surface thereof can be ensured. For this reason, by using an electrically conductive member of the present invention as the charging roller 52, DC charging to apply only a DC bias is enabled and in turn, with great reduction in etching phenomenon occurring on the surface of a photosensitive member. As a result, a running cost can also be reduced.

In the image forming apparatus shown in FIG. 6, while an electrical conductive member of the present invention is used as the charging roller 52, it can also be preferably used as the transfer roller 55.

In a case where an electrically conductive member of the present invention is used as the charging roller 52 and/or the transfer roller 55, the roller 52 or 55 may either have the same peripheral speed as or be different from that of the photosensitive member 51 when rotating the roller 52 or 55. However, by rotating the roller 52 or 55 at a- speed higher than the photosensitive member 51, variations in resistance value on the outer peripheral surface of the roller 52 or 55, if any, are dispersed, thereby enabling prevention of a great problem in a practical aspect that might be otherwise produced.

Next, there is shown another example of the image forming apparatus of the present invention.

Figure 7:
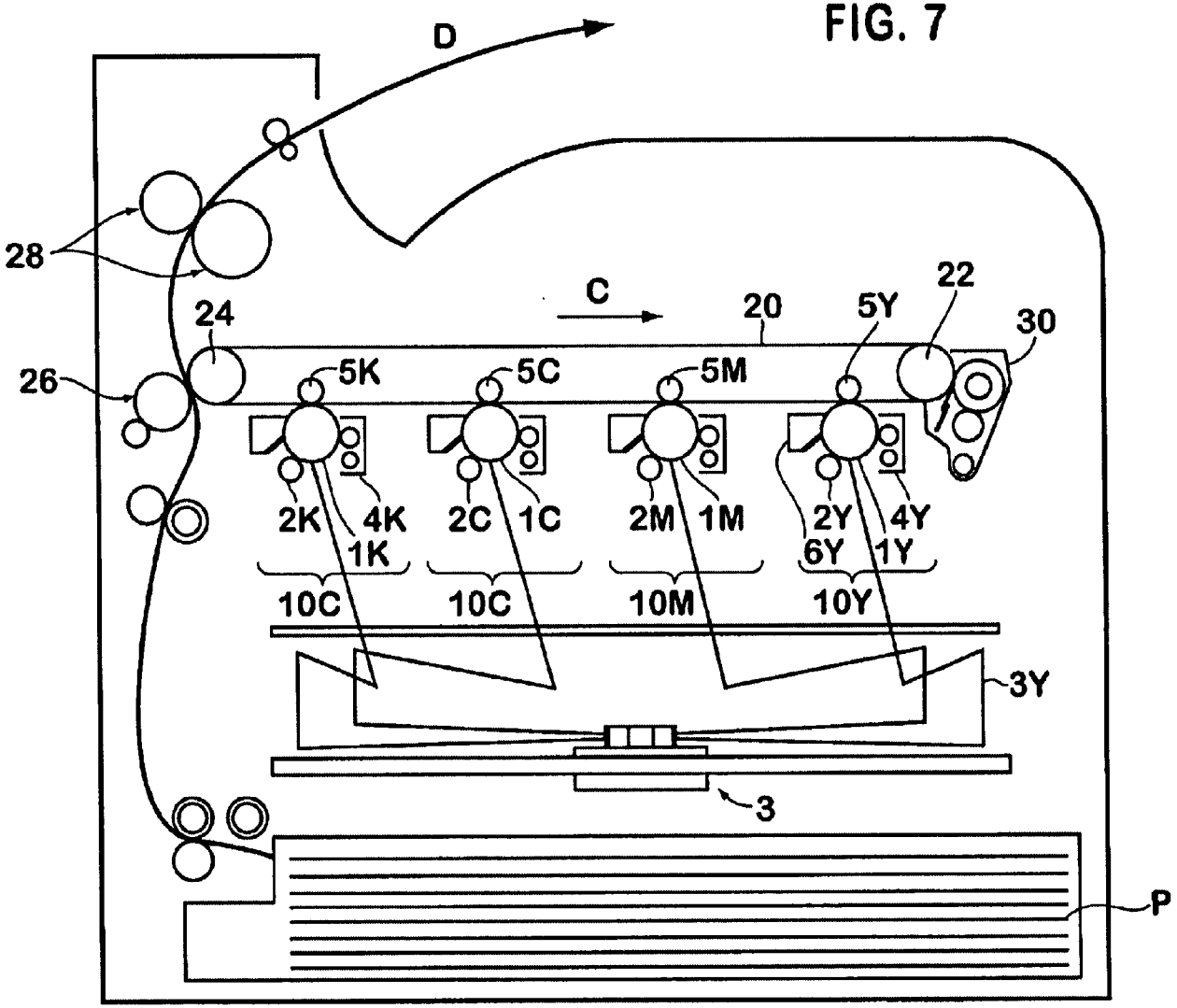
FIG. 7 is a schematic view showing a construction of a quadruple tandem type full-color image forming apparatus (an image forming apparatus of the present invention).

FIG. 7 is a schematic view showing a construction of a quadruple tandem type full-color image forming apparatus (an image forming apparatus of the present invention). The image forming apparatus shown in FIG. 7 includes first through fourth imaging stations 10Y, 10M, 10C and 10K (imaging means) of an electrophotographic type outputting images in colors including yellow (Y), magenta (M), cyan (C) and black (K) based on color separated image data. The imaging station (hereinafter simply referred to as stations) 10Y, 10M, 10C and 10K are installed at spaces of a predetermined value in parallel to each other in almost a horizontal direction.

An intermediate transfer belt 20 as an intermediate transfer member is provided in an extended manner through the stations 10Y, 10M, 10C and 10K thereabove. The intermediate transfer belt 20 in use is made of a material obtained by dispersing a material for imparting a conductivity such as carbon, an ion conductive material in a resin material such as polyimide, polycarbonate or fluororesin so as to adjust a surface resistivity to a value of the order in the range of from $10^{10}$ to $10^{12}\Omega/\square$ (at a measurement voltage of 100 V). The intermediate transfer belt 20 is spanned between and wound around a driving roller 22 and a support roller (support member) 24 installed spaced from each other in a lateral direction to run endlessly in a direction from the first station 10Y to the fourth station 10K. Note that the support roller 24 is urged in a direction of moving away from the driving roller 22 by means of a spring or the like not shown, to impart a predetermined tension to the intermediate transfer belt 20 spanned between the both rollers. Moreover, the intermediate transfer member cleaning device 30 is provided at an image bearing side surface of the intermediate transfer belt 20 at a position opposite the driving roller 22.

The above first to fourth stations 10Y, 10M, 10C and 10K have almost the same construction as each other; therefore, description will be given of the first station 10Y, as a representative, forming an image in yellow disposed in the upstream side of the intermediate transfer belt 20 in the running direction. Note that by attaching the same reference numerical symbols having a letter of magenta (M), cyan (C) or block (K) at each end instead of yellow (Y) to respective corresponding constituents having the same functions as in the first station 10Y, descriptions of the second to fourth stations 10M, 10C, and 10K are omitted.

The first station 10Y has a photosensitive member Y1 working as an image bearing member. Around the photosensitive member 1Y, a charging roller (charging means) 2Y charging the surface of the photosensitive member 1Y to a predetermined potential; an exposure device 3 exposing the charged surface of the photosensitive member 1Y with laser light 3Y according to a color separated image signal to form an electrostatic latent image; a developing device 4Y feeding charged toner (developer) to develop the electrostatic latent image; a first transfer roller (first transfer means) 5Y transferring a developed toner image onto the intermediate transfer belt 20; and a photosensitive member cleaning device 6Y removing toner remaining on the surface of the photosensitive member 1Y after the first transfer, are sequentially disposed in a rotation direction of the photosensitive member 1Y. Note that the first transfer roller 5Y is disposed inside of the intermediate transfer belt 20 opposing the photosensitive member 1Y. Moreover, bias power supplies (not shown) applying a first transfer bias are connected to the respective first transfer rollers 5Y, 5M, 5C and 5K. The bias power supplies vary transfer biases applied to respective first transfer rollers by control of a control unit (control means) not shown.

Description will be given of operations in forming an yellow image in the first station 10Y below. First of all, prior to the operations, the surface of the photosensitive member 1Y is charged to a potential of the order in the range of from −600 V to −800 V by the charging roller 2Y.

The first photosensitive member 1Y is formed by stacking a photosensitive layer on a electrically conductive base body. While the photosensitive layer is usually of a high resistance value, it has a property that a resistivity value at a portion irradiated with laser light 3Y varies when being irradiated. Therefore, the laser light 3Y is outputted by the exposure device 3 on the charged surface of the photosensitive member 1Y according to image data for yellow sent from the control unit not shown. The laser light 3Y is directed to a photosensitive layer of the surface of the photosensitive member 1Y to thereby form an electrostatic latent image having a yellow printing pattern on the surface of the photosensitive member 1Y.

An electrostatic latent image is an image formed on the surface of the photosensitive member 1Y by charging and is formed in such a way that a resistivity value in an irradiated portion of the photosensitive layer is reduced by the laser light 3, a charge accumulated on the surface of the photosensitive member 1Y flows out, while a charge in a portion not irradiated with the laser light 3Y is retained (the resulting image is a negative latent image).

The electrostatic latent image thus formed on the surface of the photosensitive member 1Y is revolved to a predetermined developing position by rotation of the photosensitive member 1Y. Then, the electrostatic latent image on the photosensitive member 1Y is visualized (toner image) at the developing position by the developing device 4Y.

In the developing device 4Y, accommodated is yellow toner having volume-average particle diameter of 7 $\mu$m formed from at least an yellow colorant, wax, a binder resin and a copolymer petroleum resin of an aliphatic hydrocarbon and aromatic hydrocarbon of 9 or more carbon atoms. Yellow toner is friction charged by stirring inside of the developing device 4Y to have a charge of the same polarity (−) as that of a charge on the surface of the photosensitive member 1Y. By passing the surface of the photosensitive member 1Y through the developing device 4Y, the yellow toner attaches electrostatically to only a latent image portion discharged on the surface of the photosensitive member 1Y and the latent image is developed with the yellow toner. Subsequent to this, the photosensitive member 1Y is rotated to transport the developed toner image on the photosensitive member 1Y to a predetermined first transfer position.

When the yellow toner image on the surface of the photosensitive member 1Y is transported to the first transfer position, a predetermined first transfer bias is applied to the first transfer roller 5Y and an electrostatic force directing from the photosensitive member 1Y to the first transfer roller 5Y acts on the toner image to transfer the toner image on the photosensitive member 1Y onto the surface of the intermediate transfer belt 20. The applied transfer bias at this time is of an inverted polarity (+) of a toner polarity (−) and for example, in the first station 10Y, constant current controlled to a value of the order of +10 $\mu$A by the control unit (not shown).

Moreover, similar control is also performed on the first transfer bias applied to the first transfer rollers 5M, 5C and 5K in the stations including the second station and those subsequent thereto.

In such a way, the intermediate transfer belt 20 onto which the yellow toner image has been transferred at the first station 10Y further runs sequentially through the second to fourth stations 10M, 10C and 10K and thereby, toner images in respective colors are superimposed in a similar manner to accomplish multi-transfer.

The intermediate transfer belt 20 onto which toner images in all the colors have been multi-transferred through the first to fourth stations moves around the driving roller 22 in the direction of an arrow C into a second transfer section constituted of the support roller 24 in contact with the inner surface of the intermediate transfer belt 20 and a second transfer roller (second transfer means) 26 disposed in the image bearing surface side of the intermediate transfer belt 20.

On the other hand, the recording paper sheet P (transfer substrate) is fed at a predetermined timing between the second transfer roller 26 and the intermediate belt 20 through a feed mechanism and a predetermined second transfer bias is applied to the support roller 24. The transfer bias applied at this time is of the same polarity (–) as that (–) of the toner and an electrostatic force directing from the intermediate transfer belt 20 to the recording paper sheet P acts on the toner image to transfer the toner image on the surface of the intermediate transfer belt 20 onto the surface of the recording paper sheet P. Note that the second transfer bias at this time is determined according to a resistance value detected by resistance detecting means (not shown) for detecting a resistance value of the second transfer section, which bias is constantly controlled voltage.

Thereafter, the recording paper sheet P is transported into a fixing device 28 and the toner image is heated and pressed, and the color-superimposed toner image is fused to permanent fixing on the surface of the recording paper sheet P. The recording paper sheet P on which a color image has been fixed is transported toward a discharge section in a direction of an arrow D, thereby completing a series of operations in color image formation.

In the image forming apparatus shown in FIG. 7, similar to the image forming apparatus shown in FIG. 6, the above electrically conductive members of the present invention can be used preferably as the charging rollers 2Y, 2M, 2C and 2K. However, the electrically conductive members of the present invention can also be used as the first transfer rollers 5Y, 5M, 5C and 5K, and/or the second transfer roller 26.

Figure 8:
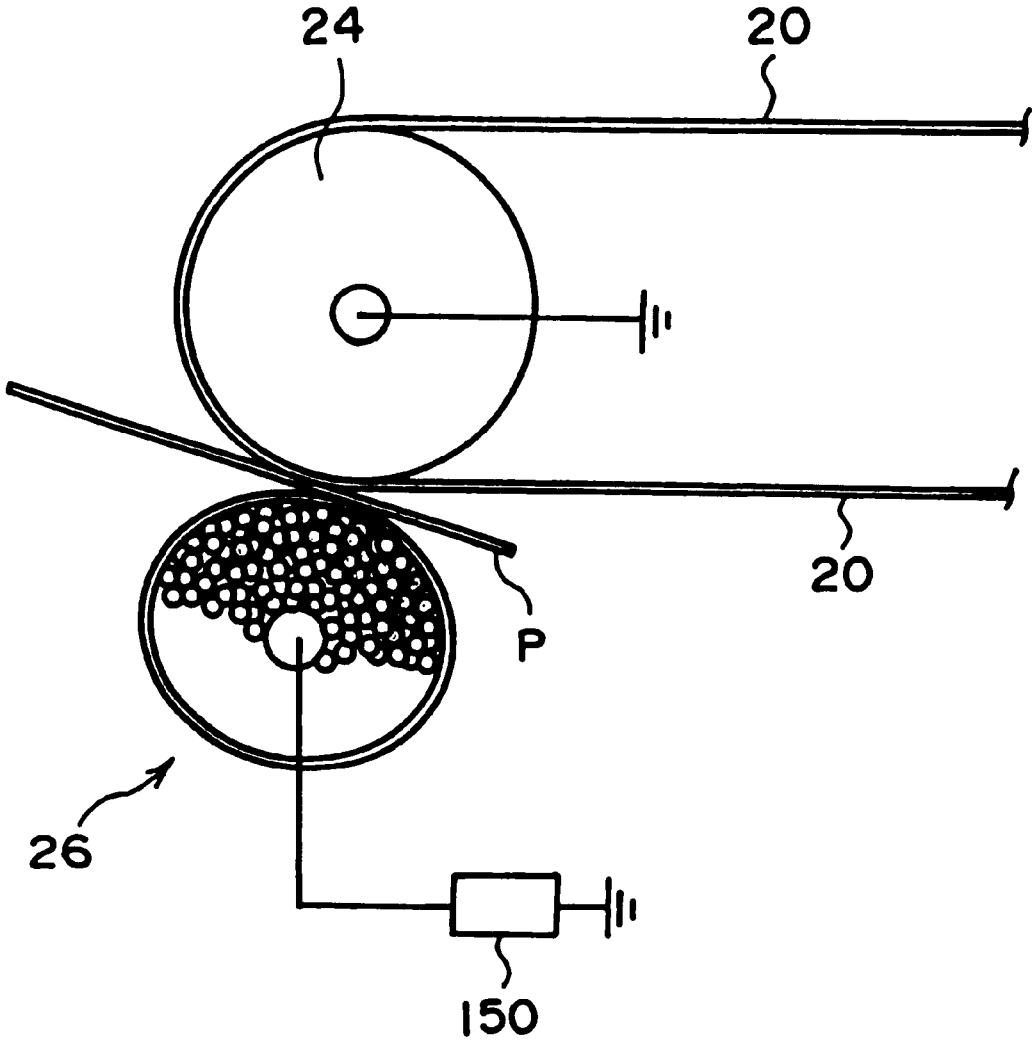
FIG. 8 is an enlarged view of a configuration in a second transfer section of the quadruple tandem type full-color image forming apparatus shown in FIG. 7.

Note that in a case where an electrical conductive member of the present invention is used as the transfer roller 26, since it is difficult to form a nip by the weight of the electrically conductive powder 130 from the view of the structure, it is preferable that the second transfer roller 26 is, as shown in FIG. 8, forced into contact with the support roller (support member) 24 from below shifted to a side relative thereto using magnetism to form a nip. Here, FIG. 8 is an enlarged view of a configuration in a second transfer section of the quadruple tandem type full-color image forming apparatus shown in FIG. 7. Moreover, since a mechanism to form a nip using magnetism is similar to the description of FIG. 4, description thereof here is omitted.

As shown in FIG. 8, in the second transfer section, a nip can be formed with certainty using magnetic characteristics by cooperation of the second transfer roller 26 having the electrically conductive powder 130 mixed with magnetic powder 130, sealed inside thereof and the support roller 24 having magnetism imparted by magnetic field forming means equipped therewith. The nip thus formed has a flexibility originating from a structure of an electrically conductive member of the present invention (due to deformation of the cylindrical base body 110) and a function for the nip to be kept in a uniform manner for a long period; therefore, it is possible for the nip to be adapted to a variety of transfer substrates such as a thin paper sheet, a thick paper sheet and in addition, a transparent sheet for OHP with flexibility, and the nip has an excellent characteristic of defect-free transportation for a transfer substrate.

The support roller 24 used in the above second transfer section is made of a material having electric conductance and magnetism in a manner similar to the case of the second transfer roller 26, but a hardness thereof is largely different from that of the second transfer roller 26. That is, since the support roller 24 also plays a role as a tension roll spanning and tensioning the belt in a case where the intermediate transfer member is of a belt-like shape, as shown in FIGS. 7 and 8, a hardness to some extent is required. As a hardness in the practical sense, it is preferably 70 degrees or more on Asker C hardness scale, for example. The support roller 24, when the intermediate transfer belt 20 is spanned, requires a high precision within several tens of $\mu$m in each of terms of, for example, an outer diameter, a deflection, a straightness and the like in order to prevent walking of the belt from occurring.

In order to obtain a support roller 24 satisfying the conditions, it is preferable to adopt a method of forming a skin film on the surface of metal, followed by magnetization thereof or a method in which a magnetic material (magnetic field means) such as ferrite or magnetite is incorporated into a resin to metal mold the blend under high pressure and to magnetize the molded intermediate.

Particularly in the present invention, as the support roller 24, it is considered as advantageous in terms of cost and a long life that a magnetic material (magnetic field forming means) such as ferrite or magnetite is incorporated into a resin to metal mold the blend under high pressure and to magnetize the molded intermediate into a multi-poled magnetic member. Here, a multi-poled magnetic member means a molded product obtained in a procedure in which a magnetic material such as a ferrite magnet or a rubber magnet is incorporated into a nylon resin or a polyester resin to metal mold the blend under high pressure into a so-called magnet roller in the shape of a cylinder.

A magnetic flux density of the support roller 24 thus obtained is different according to many of factors such as a process speed in use, an electric field caused by a potential difference between an applied voltage and the second transfer roller 26, a dielectric constant of the second transfer roller 26, a surface condition and the like, and a magnetic flux density is properly selected according to the conditions associated the factors. Magnetic flux densities measured at magnetic pole positions spaced by 1 mm above the surface of the multi-poled magnetic member are preferably 50 mT (500 gauss) or more and more preferably 100 mT (1000 gauss) or more.

Moreover, a volume resistivity of the support roller 24 is preferably in the range of from $10^3$ to $10^{12}$ Ω·cm and more preferably in the range of from $10^5$ to $10^{10}$ Ω·cm.

Moreover, in a case where the support roller 24 is made of an electromagnet, a magnetic force can be adjusted according to physical properties such as a thickness of a transfer substrate passing through between the support roller 24 and the second transfer roller 26, a moisture content, electric resistance, surface smoothness and the like.

While description is given of a preferred embodiment of the present invention as shown above, the present invention can be altered or modified in various ways without departing from the spirit and the scope of the present invention. For example, an electrically conductive member of the present invention can be used in an image forming apparatus running on an electrostatic recording process, a magnetic recording process or the like process.

EXAMPLES

Description will be given of the present invention with examples and it is intended that the present invention is not limited to the examples.

Example 1

Preparation of Electrically Conductive Member R-1 as Charging Roller

As a cylindrical base body, a seamless tube of 10 mmϕ in outer diameter, 500 μm in thickness and 320 mm in length was obtained by extruding, with an extruder, a rubber material obtained by sufficiently kneading a mixture of 100 parts by mass of epichlorohydrin rubber and 2 parts of mass of an ion conductive agent.

A stainless shaft of 9 mmϕ in outer diameter was inserted into the obtained seamless tube and a voltage of 500 V was applied to such a shaft to measure a resistance value between the shaft and a metal flat plate. As a result, a resistance value of the seamless tube was $6\times10^5\Omega$.

Moreover, part of the obtained seamless tube was cut away to measure a hardness in the thickness direction using a microrubber hardness meter (M-1) made by Kobunshi Keiki Co., Ltd. and as a result, a microrubber hardness was 55 degrees.

Still moreover, a surface smoothness was measured at 20 points on the surface of the obtained seamless tube and a mean value in ten-point mean roughness (Rz) was 3 μm.

Then, a flange member with a hole of 5 mmϕ in diameter at the center thereof is fixed to one end of the obtained seamless tube using an adhesive and a metal shaft of 5 mmϕ in outer diameter and 340 mm in length was inserted through and fixed to the hole of the flange member at the center.

Stainless spheres (a resistance value of $10^{-8}\Omega$, and a number-average particle diameter of 150 μm) and spherical composite particles composed of magnetic powder and resin (MRC, made by Toda Kogyo Corp.), as electrically conductive particles, were mixed in a volume ratio of 7 to 3 and thereafter, the seamless tube was filled with the mixture to an amount corresponding to 4/5 times the inner volume (a fill fraction of 80%) in a direction from the other end to which a flange member not fixed and then a flange member with a hole at the center thereof was fixed with an adhesive, in a manner similar to the above manner, to the other end of the seamless tube, which was open, to fabricate a charging roller R-1.

Note that, the above MRC is an abbreviation of Magnetic particle & Resin Composite Carrier and here used was MRC whose resistance value is $1\times10^5\Omega$ and a number-average particle diameter of 60 μm. A resistance value of the electrically conductive particles used in this example was $2\times10^4\Omega$ as a whole.

Evaluation (1) Evaluation of Charging Sound

The obtained charging roller R-1 was mounted to a color laser printer (made by Fuji Xerox Co., Ltd. Docu Print C620) as a charging member, set on the surface of a cylindrical image bearing member and a measurement on a charging sound was performed in an anechoic room (35 db or less). An applied bias here was such that an AC voltage of 2000 vpp was superimposed on a DC voltage −700 V and a frequency of the AC voltage was changed over 500 to 2000 Hz. Note that in the experiment, only the charging member of the color laser printer was operated.

As a result, charging sounds were measured 50 dB or less as sound intensity for any of the frequency. Since operation sounds of an image forming apparatus are usually in the range of from 52 to 55 dB; therefore charging sounds generated from the electrically conductive member of the present invention were non-problematic in a practical aspect.

(2) Evaluation of Surface Contamination and Etching Phenomenon on Image Bearing Member The obtained charging roller R-1 was mounted to a color laser printer (made by Fuji Xerox Co., Ltd. Docu Print C620) as a charging member and subjected to an imaging test under the following environments in printing on 50000 sheets. A DC voltage −700 V was used as the applied bias.

As a result, an image on an initial sheet and an image on the last of the 50000 sheets each had no problem and on the surface of the charging member, no anomalies such as damages and pin holes were observed altogether under any of conditions of a high temperature/high humidity environment (at a temperature of 28° C. and a humidity of 85% RH), a low temperature/low humidity environment (at a temperature of 10° C. and a humidity of 15% RH) and a standard environment (at a temperature of 22° C. and a humidity of 55% RH). In addition, almost no attachment of contaminants (toner, paper powder and the like) is recognized on the outer peripheral surface of the electrically conductive member R-1 either. Moreover, as a result, there was observed no difference between resistance values of the outer peripheral surface of the charging roller R-1 at the initial stage and after the 5000 sheets test, respectively.

In the test, none of anomalies such as filming of toner and the like was observed on the surface of the photosensitive member and a loss of a charge transporting layer of the photosensitive member in thickness was the maximum of 3 μm under the condition of a low temperature/low humidity environment (at a temperature of 10° C. and a humidity of 15% RH).

Example 2

Preparation of Electrically Conductive Member R-2 as Charging Roller

After drive blending of a mixture obtained by adding 10 parts by mass of electrically conductive carbon (Kechen Black EC, made by Kechen Black Inc.), 15 parts by mass of electrically conductive titanium oxide (ET-500W, made by Ishihara Sangyo, Ltd.), 3 parts by mass of an ion conductive agent (made by Japan Carlit Co., Ltd), 2 parts by mass of filler, 1 part by mass of a dispersant and 0.5 part by mass of a surface modifier to 50 parts by mass of styrene-ethylene-butylene-olefin crystalline block copolymer (SEBC:DYNARON 4600P, made by Nihon Gosei Gomu Co.) and 50 parts by mass of hydrogenated stylene-butylene copolymer (HSBR:DYNARON 2324P made by Nihon Gosei Gomu Co.), the mixture was further sufficiently kneaded using a press kneader at 200° C. for 10 min.

The kneaded intermediate outputted from the press kneader was pulverized and thereafter pelletized using a biaxial extruder. The obtained pellets were extruded using a monoaxial extruder with a cross-head to obtain a seamless tube of 10 mmϕ in outer diameter, 500 μm in thickness and a 320 mm in length.

A stainless shaft of 9 mmϕ in outer diameter was inserted into the obtained seamless tube and a voltage of 500 V was applied to such a shaft to measure a resistance value between the shaft and a metal flat plate. As a result, a resistance value of the seamless tube was $8\times10^5\Omega$.

Moreover, part of the obtained seamless tube was cut away to measure a hardness in the thickness direction using a microrubber hardness meter (MD-1) made by Kobunshi Keiki Co., Ltd. and as a result, a microrubber hardness was 60 degrees.

Still moreover, a surface smoothness was measured at 20 points on the surface of the obtained seamless tube and a mean value in ten-point mean roughness (Rz) was 2 μm.

Similar to the example 1, glass beads (a resistance value of $10^{17}\Omega$, and a number-average particle diameter of 900 $\mu$m) and carbon microbeads (a resistance value of $10^{-2}\Omega$, and a number-average particle diameter of 50 $\mu$m) as electrically conductive particles, were mixed in a volume ratio of 2 to 8 and thereafter, the seamless tube was filled with the mixture to an amount corresponding to 3/5 times the inner volume (a fill fraction of 60%) to fabricate a charging roller R-2. Note that a resistance value of the electrically conductive particles used in this example was $2\times10^{5}\Omega$ as a whole.

Evaluation (1) Evaluation of Charging Sound

The obtained charging roller R-2 was subjected to a measurement on a charging sound in conditions and a method similar to those in the example 1.

As a result, charging sounds were measured 50 dB or less as sound intensity for any of the frequencies; therefore charging sounds were non-problematic in a practical aspect.

(2) Evaluation of Surface Contamination and Etching Phenomenon on Image Bearing Member The obtained charging roller R-2 was subjected to an imaging test in conditions and a method similar to those in the example 1.

As a result, an image on an initial sheet and an image on the last of the 50000 sheets had no problem and on the surface of the charging member, no anomalies such as damages and pin holes were observed altogether under any of conditions of a high temperature/high humidity environment (at a temperature of 28° C. and a humidity of 85% RH), a low temperature/low humidity environment (at a temperature of 10° C. and a humidity of 15% RH) and a standard environment (at a temperature of 22° C. and a humidity of 55%RH). In addition, almost no attachment of contaminants (toner, paper powder and the like) is recognized on the outer peripheral surface of the electrically conductive member R-2 either. Moreover, as a result, there was observed no difference between resistance values of the outer peripheral surface of the charging roller R-2 at the initial stage and after the 50000 sheets test, respectively.

In the test, none of anomalies such as filming of toner and the like was observed on the surface of the photosensitive member and a loss of a charge sensitive layer thereof in thickness of the photosensitive member was the maximum of 3 $\mu$m under the condition of a low temperature/low humidity environment (at a temperature of 10° C. and a humidity of 15% RH).

Example 3

Preparation of Electrically Conductive Member R-3 as Charging Roller

In the example 2, a fill fraction of electrically conductive particles was changed from 60% to 40%. That is, conditions and a method similar to those in the example 2 were adopted with the exception that glass beads (a resistance value of $10^{17}\Omega$, and a number-average particle diameter of 900 $\mu$m) and carbon microbeads (a resistance value of $10^{-2}\Omega$, and a number-average particle diameter of 50 $\mu$m) were mixed in a volume ratio of 2 to 8 and thereafter, the seamless tube was filled with the mixture to an amount corresponding to 2/5 times the inner volume of a seamless tube (a fill fraction of 40%) to fabricate a charging roller R-3 of the example 3.

Thereafter, as a result of an evaluation performed in a manner similar to that in the example 2, charging sounds were measured 50 dB or less as sound intensity for any of the frequencies; therefore charging sounds were non-problematic in a practical aspect. However, in an imaging test under the condition of a low temperature/low humidity environment (at a temperature of 10° C. and a humidity of 15% RH), a slight cyclic disturbance in the images was observed on the sheets.

It is assumed that such a disturbance was caused because a tiny clearance was cyclically produced in a nip formed between the seamless tube and the photosensitive member due to the relatively small amount of the electrically conductive powder sealed in the seamless tube.

Comparative Example

Preparation of Electrically Conductive Member R-4 as Charging Roller

In the comparative example 1, an electrically conductive member R-4 was produced in a manner similar to that of example 1 except that the interior of a seamless tube was filled with electrically conductive particles to the densest filling level.

Thereafter, evaluation was performed in a manner similar to that in the example 1 and as a result, charging sounds were measured more than 60 dB as sound intensity. Further, in an imaging test under the condition of a high temperature/high humidity environment (at a temperature of 28° C. and a humidity of 85% RH), filming of toner was observed on the surface of a photosensitive member.

It is assumed that, as the interior of a seamless tube was filled with electrically conductive particles to the densest filling level, a hardness of the roller increased to an excessively high level, leading to impossibility of formation of a desired nip.

Example 4

Preparation of Electrically Conductive Member R-5 as Second Transfer Roller

After drive blending of a mixture obtained by adding 14 parts by mass of electrically conductive carbon (Kechen Black EC, made by Kechen Black Inc.), 20 parts by mass of electrically conductive titanium oxide (ET-500W, made by Ishihara Sangyo, Ltd.), 2 parts by mass of filler, 1 part by mass of a dispersant and 0.5 part by mass of a surface modifier to 30 parts by mass of HSBR (hydrogenated stylene-butadiene copolymer: DYNARON 2324P made by Nihon Gosei Gomu Co.) and 70 parts by mass of SEBC (styrene-ethylene-butylene-olefin crystalline block copolymer: DYNARON 4600P, made by Nihon Gosei Gomu Co.), which are totaled 100 parts by mass, the mixture was further sufficiently kneaded using a press kneader at 200° C. for 10 min.

The kneaded intermediate outputted from the press kneader was pulverized and thereafter pelletized using a biaxial extruder. The obtained pellets were extruded using a monoaxial extruder with a cross-head to obtain a seamless tube of 28 mmϕ in outer diameter, 1.5 mm in thickness and 330 mm in length.

A stainless shaft of 25 mmϕ in outer diameter was inserted into the obtained seamless tube and a voltage of 500 V was applied to such a shaft to measure a resistance value between the shaft and a metal flat plate. As a result, a resistance value of the seamless tube was $2\times10^{9}\Omega$.

Moreover, part of the obtained seamless tube was cut away to measure a hardness in the thickness direction using a microrubber hardness meter (MD-1) made by Kobunshi Keiki Co., Ltd. and as a result, a microrubber hardness was 50 degrees.

Still moreover, a surface smoothness was measured at 20 points on the surface of the obtained seamless tube and a mean value in ten-point mean roughness (Rz) was 1.5 $\mu$m.

Then, a flange member with a hole of 8 mmϕ in diameter at the center thereof is fixed to one end of the obtained seamless tube using an adhesive and a metal shaft of 8 mmϕ in outer diameter and 370 mm in length was inserted through and fixed with an adhesive to the hole of the flange member at the center.

Spherical composite particles composed of magnetic powder and resin (MRC, made by Toda Kogyo Corp.), as electrically conductive particles, were magnetized and thereafter, the seamless tube was filled with the spherical composite particles to an amount corresponding to 2/3 times the inner volume (a fill fraction of 67%) in a direction from the other end to which a flange member was not fixed and then a flange member with a hole at the center thereof was fixed with an adhesive, in a manner similar to the above manner, to the other end of the seamless tube, which was open, to fabricate a second transfer roller R-5.

Note that, the above MRC is an abbreviation of Magnetic particle & Resin Composite Carrier and here used was MRC of a resistance value thereof is $1\times10^5\Omega$ and a number-average particle diameter of 60 $\mu$m.

Preparation of Support Roller

A plastic magnet roller as a support roller of 28 mmϕ in outer diameter with a resin layer of 6 mm in thickness was produced by molding a compound obtained by adding 85 parts by mass of ferrite to 15 parts by mass of nylon resin 6 on the outer peripheral surface of a metal shaft of 16 mmϕ in outer diameter using an injection molder. A magnetic field was applied to such a plastic magnetic roller in a magnetizing apparatus to complete a plastic magnetic roller with a magnetic force of 120 mT (1200 gauss).

Evaluation (1) Evaluation of Second Transfer

The obtained second transfer roller R-5 and the obtained support roller were mounted to a color laser printer (Docu Print C2220 made by Fuji Xerox Co., Ltd.) as a second transfer means and subjected to an imaging test using various kinds of transfer substrates under environments shown in Table 1. An applied bias (a second transfer bias) here was set such that a DC voltage was varied over 0.5 to 4 kV to search a range of second transfer biases in which a good quality image was obtained. Results are additionally shown in Table 1.

TABLE 1

| ENVIRONMENTS | TRANSFER SUB-STRATES (PAPER) | RANGES OF SECOND TRANSFER BIASES FOR GOOD QUALITY IMAGE | | |
|---|---|---|---|---|
| | | EX-AMPLE 4 | EX-AMPLE 5 | COM. EX. 2 |
| STANDARD (22° C., 55% RH) | THIN PAPER (55 gsm) | 0.9–1.8 kv | 0.9–1.8 kv | 0.9–1.2 kv |
| | PLAIN PAPER (75 gsm) | 1.0–2.0 kv | 1.0–2.0 kv | 1.0–1.4 kv |
| | THICK PAPER (160 gsm) | 1.2–2.4 kv | 1.2–2.4 kv | 1.2–1.8 kv |
| | OHP | 1.5–3.0 kv | 1.5–3.0 kv | 1.5–2.5 kv |
| HIGH TEMPERATURE-HIGH HUMIDITY (28° C., 85% RH) | THIN PAPER (55 gsm) | 0.6–1.6 kv | 0.6–1.6 kv | 0.6–0.7 kv |
| | PLAIN PAPER (75 gsm) | 0.6–1.5 kv | 0.6–1.5 kv | 0.6–0.8 kv |
| | THICK PAPER (160 gsm) | 0.8–2.0 kv | 0.8–2.0 kv | 0.8–1.0 kv |
| | OHP | 1.0–2.5 kv | 1.0–2.5 kv | 1.0–2.0 kv |
| LOW TEMPERATURE-LOW HUMIDITY (10° C., 15% RH) | THIN PAPER (55 gsm) | 1.1–2.0 kv | 1.1–2.0 kv | 1.3–1.5 kv |
| | PLAIN PAPER (75 gsm) | 1.2–2.2 kv | 1.2–2.2 kv | 1.4–1.7 kv |
| | THICK PAPER (160 gsm) | 1.4–2.6 kv | 1.4–2.6 kv | 1.6–2.0 kv |
| | OHP | 1.7–3.5 kv | 1.7–3.5 kv | 2.2–3.0 kv |
| HIGH TEMPERATURE-HIGH HUMIDITY (28° C., 85% RH) AFTER STORED FOR 24 HR | THIN PAPER (55 gsm) | 0.6–1.4 kv | 0.6–1.4 kv | 0.6 kv |
| | PLAIN PAPER (75 gsm) | 0.6–1.4 kv | 0.6–1.4 kv | 0.7 kv |
| | THICK PAPER (160 gsm) | 0.8–1.8 kv | 0.8–1.8 kv | 0.8 kv |
| LOW TEMPERATURE-LOW HUMIDITY (10° C., 15% RH) AFTER STORED FOR 24 HR | THIN PAPER (55 gsm) | 1.2–1.8 kv | 1.2–1.8 kv | 1.5 kv |

As is clear from Table 1, on each transfer substrate, a good image was obtained in a considerably wide range of second transfer biases under any of the environments.

Moreover, a range of second transfer biases for a good quality image was obtained in a manner similar to that as described above with the exception that transfer substrates were stored for 24 hr in the condition of a high temperature-high humidity environment (at a temperature of 28° C. and a humidity of 85% RH) to sufficiently absorb moisture. Results are additionally shown in Table 1.

As is clear from Table 1, good quality images were obtained in a considerably wide range of second transfer biases even on the transfer substrates in a state of sufficient moisture contained therein.

(2) Evaluation of Release Characteristic

The obtained second transfer roller R-5 and the obtained support roller were mounted to a color laser printer (Docu Print C2220 made by Fuji Xerox Co., Ltd.) as second transfer means and transfer substrates used in an imaging test were ones that were stored for 24 hr in the condition of a low temperature-low humidity environment (at a temperature of 10° C. and a humidity of 15% RH) to adjust a moisture content to 3% or less. An applied bias (second transfer bias) here was set such that a DC voltage was varied over 0.5 to 3.0 kV to search a range of second transfer biases in which a good quality image was obtained. A release characteristic of the transfer substrates were visually observed. Results are additionally shown in Table 1.

As is clear from Table 1, good quality images were obtained in a considerably wide range of second transfer biases and absolutely no poor release characteristic was observed that a transfer substrate adheres to the intermediate belt so as not to be separated.

Example 5

Preparation of Electrically Conductive Member R-6 as Second Transfer Roller

A mixture obtained by adding 5 parts by mass of electrically conductive carbon (Kechen Black EC, made by Kechen Black Inc.), 2 parts by mass of filler and 0.5 part by mass of a dispersant to 100 parts by mass of epichlorohydrin rubber was sufficiently kneaded using a press kneader at 80° C. for 10 min.

The kneaded intermediate outputted from the press kneader was further added with 3 parts of mass of a vulcanizer and 1 part of mass of a promoter, the mixture was sufficiently kneaded using a biaxial extruder. The obtained rubber compound was extruded using a monoaxial extruder to obtain a seamless tube and the seamless tube was subjected to first vulcanization, additionally followed by second vulcanization, using a vulcanizer.

The seamless tube outputted from the vulcanizer was finished using a grinder to sizes of 28 mmϕ in outer diameter, 1.5 mm in thickness and 330 mm in length.

A stainless shaft of 25 mmϕ in outer diameter was inserted into the obtained seamless tube and a voltage of 500 V was applied to such a shaft to measure a resistance value between the shaft and a metal flat plate. As a result, a resistance value of the seamless tube was $5\times10^{9}\Omega$.

Moreover, part of the obtained seamless tube was cut away to measure a hardness in the thickness direction using a microrubber hardness meter (MD-1) made by Kobunshi Keiki Co., Ltd. and as a result, a microrubber hardness was 48 degrees.

Still moreover, a surface smoothness was measured at 20 points on the surface of the obtained seamless tube and a mean value in ten-point mean roughness (Rz) was 2.5 Then, a flange member with a hole of 8 mmϕ in diameter at the center thereof is fixed to one end of the obtained seamless tube using an adhesive and a metal shaft of 8 mmϕ in outer diameter and 370 mm in length was inserted through and fixed with an adhesive to the hole of the flange member at the center.

Spherical composite particles composed of magnet powder and resin (MRC, made by Toda Kogyo Corp.), as electrically conductive particles, were magnetized and thereafter, the seamless tube was filled with the spherical composite particles to an amount corresponding to 2/3 times the inner volume (a fill fraction of 67%) in a direction from the other end to which a flange was not fixed and then a flange member with a hole at the center thereof was fixed with an adhesive, in a manner similar to the above manner, to the other end of the seamless tube, which was open, to fabricate a second transfer roller R-6.

Note that, the above MRC is an abbreviation of Magnetic particle & Resin Composite Carrier and here used was MRC of a resistance value thereof is $1\times10^{5}\Omega$ and a number-average particle diameter of 60 $\mu$m.

Preparation of Support Roller

An electromagnet as a support roller of 28 mmϕ in outer diameter was produced by winding an electrically conductive wire of 0.5 mmϕ in outer diameter spirally on the outer peripheral surface of a metal shaft of 20 mmϕ in outer diameter and 350 mm in length and further by coating the wire-wound outer peripheral surface with nylon 12 whose surface resistivity was adjusted at $4\times10^{9}\Omega$. A magnetic force of the obtained roller was 800 mT (8000 gauss).

Evaluation (1) Evaluation of Second Transfer

The obtained charging roller R-6 and the obtained support roller were mounted to a color laser printer (Docu Print C2220 made by Fuji Xerox Co., Ltd.) as a second transfer means and subjected to an imaging test using various kinds of transfer substrates under environments shown in Table 1. An applied bias here was set such that a DC voltage was varied over 0.5 to 4 kV to search a range of second transfer biases in which a good quality image was obtained. Results are additionally shown in Table 1.

As is clear from Table 1, on each transfer substrate, good images were obtained in a considerably wide range of second transfer biases.

Moreover, a range of second transfer biases in which a good image was obtained was attained in a manner similar to that as described above with the exception that transfer substrates were stored for 24 hr in the condition of a high temperature-high humidity environment (at a temperature of 28° C. and a humidity of 85% RH) to sufficiently absorb moisture. Results are additionally shown in Table 1.

As is clear from Table 1, good quality images were obtained in a considerably wide range of second transfer biases even on the transfer substrates in a state of sufficient moisture contained therein.

(2) Evaluation of Release Characteristic

The obtained second transfer roller R-6 and the obtained support roller were mounted to a color laser printer (Docu Print C2220 made by Fuji Xerox Co., Ltd.) as second transfer means and transfer substrates used in an imaging test were ones that was stored for 24 hr in the condition of a low temperature-low humidity environment (at a temperature of 22° C. and a humidity of 57% RH) to adjust a moisture content to 3% or less. An applied bias (second transfer bias) here was set such that a DC voltage was varied over 0.5 to 4.0 kV to search a range of second transfer biases in which a good quality image was obtained. A release characteristic of each of the transfer substrates was visually observed. Results are additionally shown in Table 1.

As is clear from Table 1, good quality images were obtained in a considerably wide range of second transfer biases and absolutely no poor release characteristic was observed that a transfer substrate adheres to the intermediate belt so as not to be separated.

Second Comparative Example

Preparation of Electrically Conductive Member R-7 as Second transfer Roller

A second transfer roller R-7 of a three-layer structure was prepared by forming an electrically conductive urethane foam on the outer peripheral surface of a core metal of 12 mmϕ in outer diameter and 370 mm in length except for portions at both ends with a width of 20 mm from an end and coating a solid layer constituted of a semiconductive urethane of 1 mm in thickness on the outer peripheral surface with the urethane foam, followed by stacking an additional coat layer of urethane modified fluororesin of 0.02 mm in thickness.

The obtained second transfer roller R-7 had an outer diameter of 28 mmϕ and a resistance value of $2\times10^{9}\Omega$. A hardness thereof was 35 degrees on Asker C hardness scale.

Moreover, a surface smoothness was measured at 20 points on the surface of the obtained seamless tube and a mean value in ten-point mean roughness (Rz) was 5 $\mu$m.

Preparation of Support Roller

A single layer roller R-7 was prepared by forming a rubber layer of 6 mm in thickness made of EPDM containing electrically conductive carbon dispersed therein on the outer peripheral surface of a metal shaft of 16 mmϕ in outer diameter and 350 mm in length except for portions at both ends with a width of 10 mm from an end. The obtained second transfer roller R-7 had an outer diameter of 28 mmϕ and a resistance value of $3\times10^{9}\Omega$. A hardness thereof was 72 degrees on Asker C hardness scale.

Evaluation (1) Evaluation of Second Transfer

The obtained charging roller R-7 and the obtained support roller were mounted to a color laser printer (Docu Print C2220 made by Fuji Xerox Co., Ltd.) as a second transfer means and subjected to an imaging test using various kinds of transfer substrates under environments shown in Table 1. An applied bias (second transfer bias) here was set such that a DC voltage was varied over 0.5 to 4.0 kV to search a range of second transfer biases in which a good quality image was obtained. Results are additionally shown in Table 1.

As is clear from Table 1, on each transfer substrate, no good image was obtained in any of the environments in as wide a range of second transfer biases as those of the example 4 and example 5.

Moreover, a range of second transfer biases attaining a good quality image was determined in a manner similar to that as described above with the exception that transfer substrates were stored for 24 hr in the condition of a high temperature-high humidity environment (at a temperature of 28° C. and a humidity of 85% RH) to sufficiently absorb moisture. Results are additionally shown in Table 1.

As is clear from Table 1, a good quality image was not obtained in a considerably wide range of second transfer biases on each of the transfer substrates in a state of sufficient moisture being contained therein, while a good quality image was obtained only in an extremely narrow range of second transfer biases.

(2) Evaluation of Release Characteristic

The obtained second transfer roller R-7 and the obtained support roller were mounted to a color laser printer (Docu Print C2220 made by Fuji Xerox Co., Ltd.) as second transfer means and transfer substrates used in an imaging test were ones that were stored for 24 hr in the condition of a low temperature-low humidity environment (at a temperature of 10° and a humidity of 15% RH) to adjust a moisture content to 3% or less. An applied bias (second transfer bias) here was such that a DC voltage was varied over 0.5 to 4.0 kV to search a range of second transfer biases in which a good quality image was obtained. A release characteristic of the transfer substrates were visually observed. Results are additionally shown in Table 1.

As is clear from Table 1, a good quality image was not obtained in a considerably wide range of second transfer biases while being obtained only in an extremely narrow range of second transfer biases. Poor release characteristic was observed that a transfer substrate adheres to the belt so as not to be separated.

It is assumed that, when a solid layer made of semiconductive urethane is coated on the outer peripheral surface of an electrically conductive urethane foam of the second transfer roller used in the second comparative example, the solid layer intrudes locally into cells in the urethane foam to thereby increase a thickness of the solid layer locally, with the result that variations in a hardness of the second transfer roller are produced and thereby no uniform nip can be formed; therefore a transfer substrate is easily subjected to a contact failure with an intermediate transfer belt at a position thereof corresponding to a high hardness portion on the roller, resulting in poor release characteristic.

In contrast, the second transfer rollers R-5 and R-6 of the fourth and example 5s have a state of the interior of the cylindrical base body occupied by a clearance and an electrically conductive powder containing magnetic powder to thereby, form a constantly uniform nip between the support roller and the second transfer roller R-5 or R-6, therefore, the nip does not receive a great influence from a change in physical property of a transfer substrate, which allows for a wide range of second transfer biases in which a good quality image is obtained and exerts an excellent effect of a good release characteristic of a transfer substrate.

According to the present invention, there can be provided an electrically conductive member capable of not only forming a desired nip with certainty, simplicity and ease at a low cost but also preventing contamination or denaturation of a photosensitive member or an intermediate member. In the present invention, there can also be provided an image forming apparatus with the electrically conductive member. Moreover, there can be provided an electrically member capable of reducing a charging sound and an etching phenomenon on an image bearing member and an image forming apparatus with such an electrically conductive member. Furthermore, there can be provided an electrically conductive member excellent in resistance uniformity and surface smoothness and an image forming apparatus with such an electrically conductive member.

What is claimed is:

1. An electrically conductive member, for use in an image forming apparatus, the electrically conductive member comprising:

a cylindrical base body; and electrically conductive powder sealed inside of said cylindrical base body in a substantially flowable state.

2. An electrically conductive member according to claim 1, wherein a fill fraction of said electrically conductive powder fills only 20 to 95% of the inner volume of said cylindrical base body.

3. An electrically conductive member according to claim 1, wherein a fill fraction of said electrically conductive powder is in the range of from 50 to 95% of the inner volume of said cylindrical base body.

4. An electrically conductive member according to claim 1, wherein a fill fraction of said electrically conductive powder is in the range of from 70 to 90% of the inner volume of said cylindrical base body.

5. An electrically conductive member according to claim 1, wherein a resistance value of said electrically conductive powder as a whole is in the range of from $10^{-8}$ to $10^{8}\Omega$.

6. An electrically conductive member according to claim 1, wherein said electrically conductive powder is a mixture of different kinds of powder constituents and a resistance value of each of said powder constituents is in the range of from $10^{-8}$ to $10^{17}\Omega$.

7. An electrically conductive member according to claim 1, wherein a number average particle diameter of said electrically conductive powder is in a range of from $10^{-5}$ $\mu$m to 1 mm.

8. An electrically conductive member according to claim 1, wherein said cylindrical base body comprises a magnetic material.

9. An electrically conductive member according to claim 1, wherein said cylindrical base body is of a layered structure.

10. An electrically conductive member according to claim 1, wherein the outer peripheral surface of said cylindrical base body comprises a deformable material which deforms due to weight of said electrically conductive powder and/or motion thereof.

11. An electrically conductive member according to claim 1, where the cylindrical base body is adapted for use as a roller.

12. An electrically conductive member according to claim 1, further including a shaft passing through said cylindrical base body in an axial direction thereof for serving as an axis for rotating the cylindrical base body thereabout.

13. An electrically conductive member according to claim 12, wherein said shaft is fixed by flange members provided at both ends of said cylindrical base body.

14. An electrically conductive member according to claim 13, wherein said flange members are made of an elastomeric material.

15. An electrically conductive member according to claim 1, wherein said electrically conductive powder contains magnetic powder.

16. An electrically conductive members, for use in an image forming apparatus, comprising:

a cylindrical base body; and electrically conductive powder sealed inside of said cylindrical base body so a not to completely fill the inner volume thereof.

17. An electrically conductive members, for use in an image forming apparatus, comprising:

a cylindrical base body; and electrically conductive powder sealed inside of said cylindrical base body at a fill fraction in the range of from 20 to 95% of the inner volume thereof.

18. An image forming apparatus comprising: an image bearing member; and charging means contacting said image bearing member to charge a surface of said image bearing member, wherein said charging means comprises an electrically conductive member including: a cylindrical base body; and electrically conductive powder sealed inside of said cylindrical base body in a substantially flowable state.

19. An image forming apparatus according to claim 18, wherein said charging means includes applying a DC bias voltage or a DC voltage on which an AC voltage is superimposed.

20. An image forming apparatus according to claim 18, wherein said image bearing member and said electrically conductive member are relatively rotated about respective axes thereof by providing a differential peripheral speed therebetween.

21. An image forming apparatus comprising: an image bearing member; and charging means contacting said image bearing member to charge a surface of said image bearing member, wherein said charging means comprising an electrically conductive member including:

a cylindrical base body; and electrically conductive powder sealed inside of said cylindrical base body so as not to completely fill the inner volume thereof.

22. An image forming apparatus comprising: an image bearing member; and charging means contacting said image bearing member to charge a surface of said image bearing member, wherein said charging means comprising an electrically conductive member including:

a cylindrical base body; and electrically conductive powder sealed inside of said cylindrical base body at a fill fraction in the range of from 20 to 95% of the inner volume thereof.

23. An image forming apparatus comprising: an image bearing member; and transfer means contacting said image bearing member to transfer a toner image on a surface thereof onto a transfer substrate, wherein said transfer means comprises an electrically conductive member including: a cylindrical base body; and electrically conductive powder sealed inside of said cylindrical base body in a substantially flowable state.

24. An image forming apparatus according to claim 23, wherein said image bearing member and said electrically conductive member are relatively rotated about respective axes thereof by providing a differential peripheral speed therebetween.

25. An image forming apparatus comprising: an image bearing member; and transfer means contacting said image bearing member to transfer a toner image on a surface thereof onto a transfer substrate, wherein said transfer means comprises an electrically conductive member including: a cylindrical base body; and electrically conductive powder sealed inside of said cylindrical base body so as not to fill the inner volume thereof to the full.

26. An image forming apparatus comprising: an image bearing member; and transfer means contacting said image bearing member to transfer a toner image on a surface thereof onto a transfer substrate, wherein said transfer means comprises an electrically conductive member including a cylindrical base body; and electrically conductive powder sealed inside of said cylindrical base body at a fill fraction in the range of from 20 to 95% of the inner volume thereof.

27. An image forming apparatus comprising: an image bearing member; charging means contacting said image bearing member to charge a surface thereof; first transfer means contacting said image bearing member to transfer a toner image on the surface thereof to an intermediate transfer member; and second transfer means contacting said intermediate transfer member to transfer a toner image on a surface thereof to a transfer substrate, wherein at least one of said charging means, said first transfer means and said second transfer means comprises an electrically conductive member including: a cylindrical base body; and electrically conductive powder sealed inside of said cylindrical base body in a substantially flowable state.

28. An image forming apparatus comprising: an image bearing member; charging means contacting said image bearing member to charge a surface thereof; first transfer means contacting said image bearing member to transfer a toner image on the surface thereof to an intermediate transfer member; and second transfer means contacting said intermediate transfer member to transfer a toner image on a surface thereof to a transfer substrate, wherein at least one of said charging means, said first transfer means and said second transfer means comprises an electrically conductive member including: a cylindrical base body; and electrically conductive powder sealed inside of said cylindrical base body so as not to fill the inner volume thereof to the full.

29. An image forming apparatus comprising: an image bearing member; charging means contacting said image bearing member to charge a surface thereof; first transfer means contacting said image bearing member to transfer a toner image on the surface thereof to an intermediate transfer member; and second transfer means contacting said intermediate transfer member to transfer a toner image on a surface thereof to a transfer substrate, wherein at least one of said charging means, said first transfer means and said second transfer means comprises an electrically conductive member including a cylindrical base body; and electrically conductive powder sealed inside of said cylindrical base body at a fill fraction in the range of from 20 to 95% of the inner volume thereof.

30. An image forming apparatus comprising: an image bearing member; charging means contacting said image bearing member to charge a surface thereof; first transfer means contacting said image bearing member to transfer a toner image on the surface thereof to an intermediate transfer member; and second transfer means contacting said intermediate transfer member to transfer a toner image on a surface thereof to a transfer substrate, wherein at least one of said charging means, said first transfer means and said second transfer means comprises an electrically conductive member including: a cylindrical base body; and electrically conductive powder sealed inside of said cylindrical base body in a substantially flowable state and said electrically conductive powder includes magnetic powder, said image forming apparatus further comprising: magnetic field forming means forming a magnetic field in which said electrically conductive powder is attracted to said image bearing member or said intermediate transfer member.

31. An image forming apparatus according to claim 30, wherein said magnetic field forming means is a film having magnetism provided on an inner peripheral surface of said image bearing member or said intermediate transfer member.

32. An image forming apparatus according to claim 30, wherein said magnetic field forming means is a magnetic force generating member provided at a position opposite said electrically conductive member on an inner peripheral section of said image bearing member or said intermediate transfer member.

33. An image forming apparatus according to claim 30, wherein said image bearing member or said intermediate transfer member includes a base body made of a magnetic material and said magnetic field forming means is said base body.

34. An image forming apparatus including: an image bearing member; charging means contacting said image bearing member to charge a surface thereof; first transfer means contacting said image bearing member to transfer a toner image on the surface thereof to an intermediate transfer member; and second transfer means contacting said intermediate transfer member to transfer a toner image on a surface thereof to a transfer substrate, wherein at least one of said charging means, said first transfer means and said second transfer means comprises an electrically conductive member including: a cylindrical base body; and electrically conductive powder sealed inside of said cylindrical base body so as not to fill the inner volume thereof to the full and said electrically conductive powder includes magnetic powder, said image forming apparatus further including: magnetic field forming means forming a magnetic field in which said electrically conductive powder is attracted to said image bearing member or said intermediate transfer member.

35. An image forming apparatus comprising: an image bearing member; charging means contacting said image bearing member to charge a surface thereof; first transfer means contacting said image bearing member to transfer a toner image on the surface thereof to an intermediate transfer member; and second transfer means contacting said intermediate transfer member to transfer a toner image on a surface thereof to a transfer substrate, wherein at least one of said charging means, said first transfer means and said second transfer means comprises an electrically conductive member including a cylindrical base body; and electrically conductive powder sealed inside of said cylindrical base body at a fill fraction in the range of from 20 to 95% of the inner volume thereof and said electrically conductive powder includes magnetic powder, said image forming apparatus further including: magnetic field forming means forming a magnetic field in which said electrically conductive powder is attracted to said image bearing member or said intermediate transfer member.

36. An image forming apparatus comprising: an image bearing member; first transfer means contacting said image bearing member to transfer a toner image on the surface thereof to an intermediate transfer member in the shape of an endless belt; and second transfer means contacting said intermediate transfer member to transfer a toner image on a surface thereof to a transfer substrate, wherein said second transfer means comprises an electrically conductive member including: a cylindrical base body; and electrically conductive powder sealed inside of said cylindrical base body in a substantially flowable state and said electrically conductive powder includes magnetic powder, said image forming apparatus further comprising: magnetic field forming means forming a magnetic field in which said electrically conductive powder is attracted to a support member provided at a position opposite said second transfer means on an inner peripheral section of said intermediate transfer member.

37. An image forming apparatus comprising: an image bearing member; first transfer means contacting said image bearing member to transfer a toner image on the surface thereof to an intermediate transfer member in the shape of an endless belt; and second transfer means contacting said intermediate transfer member to transfer a toner image on a surface thereof to a transfer substrate, wherein said second transfer means comprises an electrically conductive member including: a cylindrical base body; and electrically conductive powder sealed inside of said cylindrical base body so as not to completely fill the inner volume thereof and said electrically conductive powder includes magnetic powder, said image forming apparatus further comprising: magnetic field forming means forming a magnetic field in which said electrically conductive powder is attracted to a support member provided at a position opposite said second transfer means on an inner peripheral section of said intermediate transfer member.

38. An image forming apparatus comprising: an image bearing member; first transfer means contacting said image bearing member to transfer a toner image on the surface thereof to an intermediate transfer member in the shape of an endless belt; and second transfer means contacting said intermediate transfer member to transfer a toner image on a surface thereof to a transfer substrate, wherein said second transfer means comprises an electrically conductive member including a cylindrical base body; and electrically conductive powder sealed inside of said cylindrical base body at a fill fraction in the range of from 20 to 95% of the inner volume thereof and said electrically conductive powder includes magnetic powder, said image forming apparatus further comprising: magnetic field forming means forming a magnetic field in which said electrically conductive powder is attracted to a support member provided at a position opposite said second transfer means on an inner peripheral section of said intermediate transfer member.

* * * * *